US007075485B2

(12) United States Patent
Song et al.

(10) Patent No.: US 7,075,485 B2
(45) Date of Patent: Jul. 11, 2006

(54) LOW COST MULTI-BEAM, MULTI-BAND AND MULTI-DIVERSITY ANTENNA SYSTEMS AND METHODS FOR WIRELESS COMMUNICATIONS

(75) Inventors: Peter Chun Teck Song, Hong Kong (HK); Ross David Murch, Kowloon (HK); Angus Mak Chi Keung, Hong Kong (HK); Douglas Ronald George, Kowloon (HK); Piu Bill Wong, Hong Kong (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 119 days.

(21) Appl. No.: 10/720,716

(22) Filed: Nov. 24, 2003

(65) Prior Publication Data

US 2005/0110683 A1 May 26, 2005

(51) Int. Cl.
*H01Q 1/38* (2006.01)
*H01Q 21/00* (2006.01)

(52) U.S. Cl. ..... 343/700 MS; 343/850; 343/853

(58) Field of Classification Search ..... 343/700 MS, 343/725, 729, 737, 833–834, 850, 893; 455/562
See application file for complete search history.

(56) References Cited

U.S. PATENT DOCUMENTS 5,166,693 A * 11/1992 Nishikawa et al. ..... 342/422
5,534,877 A * 7/1996 Sorbello et al. ..... 343/700 MS
5,561,434 A * 10/1996 Yamazaki ..... 343/700 MS
5,581,266 A * 12/1996 Peng et al. ..... 343/770
5,610,617 A * 3/1997 Gans et al. ..... 342/373
5,694,416 A 12/1997 Johnson
5,990,835 A * 11/1999 Kuntzsch et al. .... 343/700 MS
6,091,365 A * 7/2000 Derneryd et al. .... 343/700 MS
6,114,998 A * 9/2000 Schefte et al. ..... 343/700 MS
6,731,245 B1 * 5/2004 Stotler et al. ..... 343/700 MS
6,771,221 B1 * 8/2004 Rawnick et al. ..... 343/700 MS
6,795,020 B1 * 9/2004 Sreenivas et al. .... 343/700 MS
2004/0150561 A1 * 8/2004 Tillery et al. ..... 343/700 MS

FOREIGN PATENT DOCUMENTS

CN 1322414 11/2001
KR 20020081791 10/2002

OTHER PUBLICATIONS

U.S. Appl. No. 10/078,062, filed Sep. 2002, Lee et al.
U.S. Appl. No. 10/274,834, filed Apr. 2004, Jason et al.

(Continued)

*Primary Examiner*—Trinh Vo Dinh
(74) *Attorney, Agent, or Firm*—Fulbright & Jaworski LLP

(57) ABSTRACT

Systems and methods for employing switched phase shifters and a feed network to provide a low cost multiple beam antenna system for wireless communications. The present systems and methods may also facilitate multi-band communications and employ multi-diversity. The present systems and methods allow communication systems to achieve enhanced performance for communication or other services such as location tracking. The present systems and methods may employ switched phase shifters, multiple diversity antennas and/or a feed network having a multi-layer construction to provide an antenna system with low losses, low external component count and/or which is thin and compact.

126 Claims, 20 Drawing Sheets

OTHER PUBLICATIONS

U.S. Appl. No. 10/348,843, filed Jul. 2004, Song et al.
U.S. Appl. No. 10/635,367, filed Feb. 2005, Gong et al.
U.S. Appl. No. 10/677,418, filed Apr. 2005, Lei et al.
Lee, Richard Q. et al., "Experimental Study of the Two-Layer Electromagnetically Coupled Rectangular Patch Antenna", IEEE Transactions on Antennas and Propagaton, vol. 38, No. 8, Aug. 1990, pp. 1298-1302.
Koul, Shiban et al., "Microwave and Millimeter Wave Phase Shifters", vol. II, Semiconductor and Delay Line Phase Shifters, Artech House Publishing, 1991, pp. 414-415.
Sakagami, Iwata et al., "A Reduced Branch-Line Coupler with Eight Stubs", 1997 Asia Pacific Microwave Conference, 4 pages.

* cited by examiner

LOW COST MULTI-BEAM, MULTI-BAND AND MULTI-DIVERSITY ANTENNA SYSTEMS AND METHODS FOR WIRELESS COMMUNICATIONS

CROSS-REFERENCE TO RELATED APPLICATIONS

The present invention is related to co-pending and commonly assigned U.S. patent application Ser. No. 10/278,062, entitled "DYNAMIC ALLOCATION OF CHANNELS IN A WIRELESS NETWORK", filed Dec. 16, 2002; Ser. No. 10/274,834, entitled "SYSTEMS AND METHODS FOR MANAGING WIRELESS COMMUNICATIONS USING LINK SPACE INFORMATION", filed Jan. 2, 2003; Ser. No. 10/348,843, entitled "WIRELESS LOCAL AREA NETWORK TIME DIVISION DUPLEX RELAY SYSTEM WITH HIGH SPEED AUTOMATIC UP-LINK AND DOWN-LINK DETECTION", filed Jan. 2, 2003; Ser. No. 10/677,418, entitled "SYSTEM AND METHOD FOR PROVIDING MULTIMEDIA WIRELESS MESSAGES ACROSS A BROAD RANGE AND DIVERSITY OF NETWORKS AND USER TERMINAL DISPLAY EQUIPMENT", filed Oct. 2, 2003; and Ser. No. 10/635,367, entitled "LOCATION POSITIONING IN WIRELESS NETWORKS", filed Aug. 6, 2003; the disclosures of which are incorporated herein by reference.

TECHNICAL FIELD

The present invention is generally related to wireless communication systems and specifically related to low cost, multi-beam, multi-band and multi-diversity antenna systems for use in wireless communications.

BACKGROUND OF THE INVENTION

Typical existing wireless communication antennas capable of providing adaptive beam forming and/or multiple beam switching are relatively expensive. No low cost antenna solution provides multiple beams along with antenna diversity, particularly an antenna that would further provide multiple bands and/or multiple services. Thus, the prior art fails to provide an economical antenna system that has variable beams, reconfigurable for different beam patterns or an economical antenna system that provides communication via multiple bands using multiple services.

Gans et al., U.S. Pat. No. 5,610,617, entitled Directive Beam Selectivity for High Speed Wireless Communication Networks, uses butler matrices to form beams for use in wireless communications. The disclosure of Gans is incorporated herein by reference. The antenna of Gans selectively provides a narrow beam in different directions. Thus, using the Gans antenna one may provide a narrow beam to one side or a narrow beam straight ahead. In such existing butler matrices the number of beams are limited by the number of inputs and outputs to the matrix. By way of example, in an existing Butler matrix with four input ports and four output ports, the matrix typically only provides four beams for a user to select from.

Existing, so called, adaptive antenna arrays, use components which render the cost of the system very high. Typically in such adaptive antenna arrays, amplifiers and phase shifter circuits are attached to each antenna element, or at least each column of the array. So by way of example, if an existing adaptive antenna array has 64 elements, it may have 64 sets of phase shifters and/or 64 amplifiers/attenuators, or at least one set of phase shifters and/or one set of amplifiers/attenuators for each column of the array. This dramatically increases the cost and complexity of the entire system. These components typically provide an ability to change the magnitude and the phase at each element. Such adaptive antenna arrays require amplifiers and phase shifters to obtain a desired phase and amplitude progression across the array. As phase shifting also induces signal strength losses, amplifiers are also used in an attempt to recoup these losses as well to increase the adaptability of the system. In antenna systems, noise is an important parameter. By using amplifiers at the antenna the noise performance of the adaptive antenna array is also enhanced to also overcome noise created by the phase shifters. An antenna element known in the art is an electromagnetically coupled patch antenna described by R. Q. Lee et. al. in IEEE Transactions on Antennas and propagation, Vol. 38, No. 8, August 1990, the disclosure of which is incorporated herein by reference.

BRIEF SUMMARY OF THE INVENTION

The present invention is directed to system and method embodiments which employ switched phase shifters and a feed network to provide a low cost manner of achieving multiple beam system for wireless communication systems. Embodiments of the present systems and methods may also facilitate multi-band communications and employ multi-diversity. Such multiple beam, multiple band system and method embodiments allow communication systems to achieve enhanced performance for communication or other services such as location tracking. Embodiments of the present systems and methods may employ switched phase shifters, multiple diversity antennas and/or a feed network having a multi-layer construction to provide an antenna system with low losses, low external component count and/or which is thin and compact.

Advantageously, embodiments of the present invention enable multiple beams to be formed simultaneously in different directions in the same frequency band, while providing flexible selection of beam directions, beam widths and beam shapes that can be controlled digitally. The present array is preferably compact and thin, relatively low cost and may operate over multiple bands. Higher band elements may be embedded within lower band elements of an array embodiment, giving similar radiation characteristic on both bands, through both bands sharing the same aperture. A reference-based network may be used, instead of complex Butler matrices, this preferably reduces the number of phase shifter circuits. The phase shifters of embodiments of the present invention have a compact design and may employ a low loss PIN diode network design. The present invention further provides ultra-wideband with greater than twenty percent bandwidth in each band, dual polarization diversity scanning and low manufacturing tolerance for reduced manufacturing cost.

The present antenna system can be connected to a wireless communication system such as a wireless LAN or cellular telecommunications network and may be used to enhance performance by appropriately utilizing directional and/or multiple beams. For example, the beams can be utilized to improve coverage in certain directions or for tracking, enhancing location estimation. The beams can also be used to avoid interference in certain directions. Embodiments of the present array can form at least two patterns, simultaneously in some embodiments, that are independent or uncoupled so that diversity may be provided to one or more users, and/or so that multiple users can be serviced. The present systems and methods may employ at least the following components.

A variety of different types of antenna elements may be used in the present systems and methods. However, gain, bandwidth, diversity, size and mutual coupling between elements are all considerations for use in the present systems and methods. One suitable element is disclosed in the Lee reference incorporated above. However the present invention may employ novel antenna elements discussed below which are particularly well suited for use by the present systems and methods. Antenna elements of various embodiments of the present invention may employ various beam characteristics, such as forms of diversity including polarization diversity. Thus, elements of embodiments of the present invention may employ multiple branches with two or more feeds that can be used to transmit or receive independent signals with low cross-correlation. Various antenna element configurations and arrangements employed in accordance with embodiments of the present invention allow tighter packing density in an array panel compared to conventional designs. This enable elements to be placed close to each other and still perform in a favorable manner. Also, the bandwidth of the antenna element may be relatively wide in accordance with various embodiments of the present invention, so as to cover the entire spectrum of operation bands for a particular application.

Multiple antenna elements with the aforementioned multiple branch wideband configurations are appropriately located and spaced on a supporting structure or panel which may be planar or of other conformal shape to provide an array configuration. The layout of elements on the panel provides room for elements operating at different bands while maintaining low mutual coupling by providing sufficient spacing. The array is preferably laid out to accommodate elements for multiple bands within the same area so that the bands share the same aperture.

The phase shifters in embodiments of a shifter network of the present invention are low cost and compact, requiring few external components while providing discrete phases that can be digitally controlled. The present phase shifters may take the form of a very low loss switching circuit. The present systems and methods may employ delay line phase shifts and PIN diodes, varactor diodes or the like, to further reduce loss. The present systems and methods preferably does away with the need for amplitude control through amplifiers, or at least greatly reduces the need for amplitude control, because the phase shifters employed are very low loss and do not contribute any appreciable noise. Elimination of the amplifiers greatly reduces cost of the array and its operation. The discrete phases employed by the present systems and method may, by way of example, be zero, 90, 180, and 270 degrees.

The antennas and phase shifters are preferably connected by a feed network that allows multiple beams to be formed in independent directions at multiple frequency bands. The feed network is preferably optimized to reduce coupling between the antennas and phase shifters are optimized to reduce losses, both while being compact. Different methods and systems for feeding the array elements may be used to reduce cross-polarization and to reduce the number of PIN diodes used, resulting in greater cost reductions.

The present systems and methods also preferably provide fault detection for malfunctions within the array. This fault detection may employ port detection to facilitate quick diagnostic testing of the array. For example, polling an antenna panel to find out if it is drawing the correct current may be used to detect faulty PIN diodes.

The present antenna array preferably enables better performance of the overall wireless communication system. Embodiments of the present systems and methods preferably employ a phase shifter and/or switching approach for beam forming and allows diversity to be easily built into an array. In contrast to typical Butler matrices, not only may the present array be used to provide narrow beams to one side or directly ahead, but also to provide a more omnidirectional pattern or different types of patterns, which may be combinations of narrow beam directions. The number of beams that can be formed in the present array is not dependent on inputs and outputs, and thus is not limited to a predetermined number of beams. Resultantly the present array is much more flexible.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

Various embodiments of the present systems and method may be used to form multiple beams simultaneously in different directions and/or with different attributes or characteristics, such as beam width, polarizations, or the like, using low cost panels. Embodiments of the present systems and methods provide different manners for reducing costs and providing solutions by varying the feed network employed. The present systems and methods may make use of inexpensive PIN or varactor diodes while maintaining performance and operating in multiple bands. In accordance with embodiments of the present systems and methods an array can employ closely packed, interleaved elements without sacrificing the radiation pattern resulting in a thin, compact array. The array may be further reduced in size through the use of switched phase shifters, eliminating the need for a bulky butler matrix. Multiple operating bands having the same aperture may result from interleaving elements for the various bands on a panel. The bandwidth of an array of the present invention may also be very broad. For example, a full gigahertz of bandwidth coverage may be provided at the high band in an array of the present invention. Digitized scanning capability is provided by panel embodiments, particularly those employing embodiments of the stacked patch element configurations. The array panels of the present invention are very broadband so manufacturing tolerances are generous, as slight variations will not greatly affect the bandwidth, or affect the bands of operation.

Figure 1:
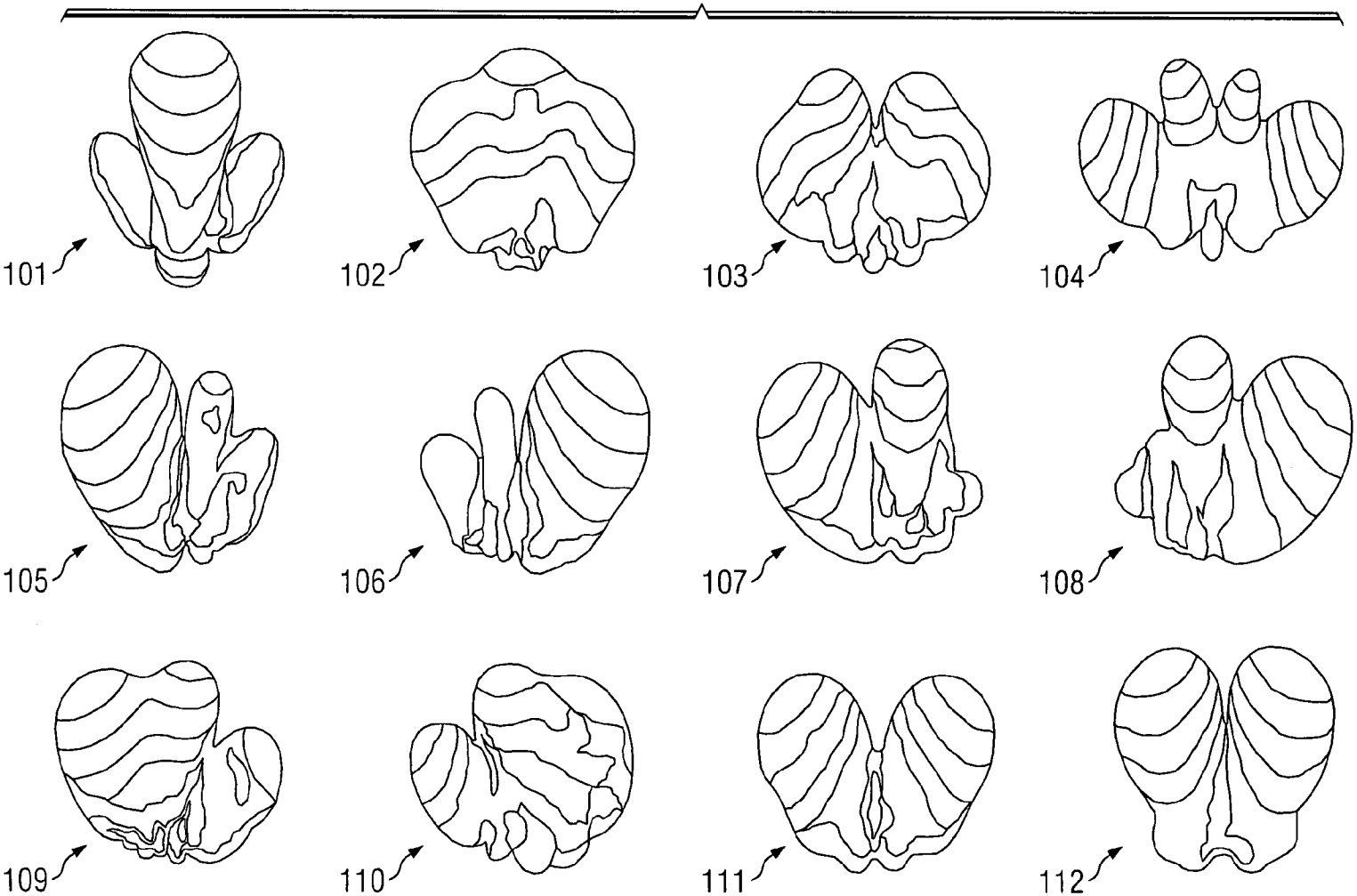
FIG. 1 is a diagrammatic illustration of various beam patterns produced in accordance with at least one embodiment of the present invention.

FIG. 1 is an illustration of various beam patterns 101 through 112 produced in accordance with embodiments of the present systems and methods. Digital selection of phase shifts allows selection of these, or similar beam patterns. As will be appreciated by one of ordinary skill in the art the various beams have useful properties. For example, patterns 101, 105, and 106 can be used for beam scanning. Pattern 102 provides a broad beam for providing good coverage throughout a service area.

Embodiments of the present invention preferably employ antenna elements that have multiple antennas integrated therein. These elements may be generally referred to as having multi-branch diversity or referred more specifically to as having two, three or four branch diversity, or the like. Antenna elements and arrays provided in accordance with the present invention are shown on FIGS. 2 through 20 and are described below.

Figure 2:
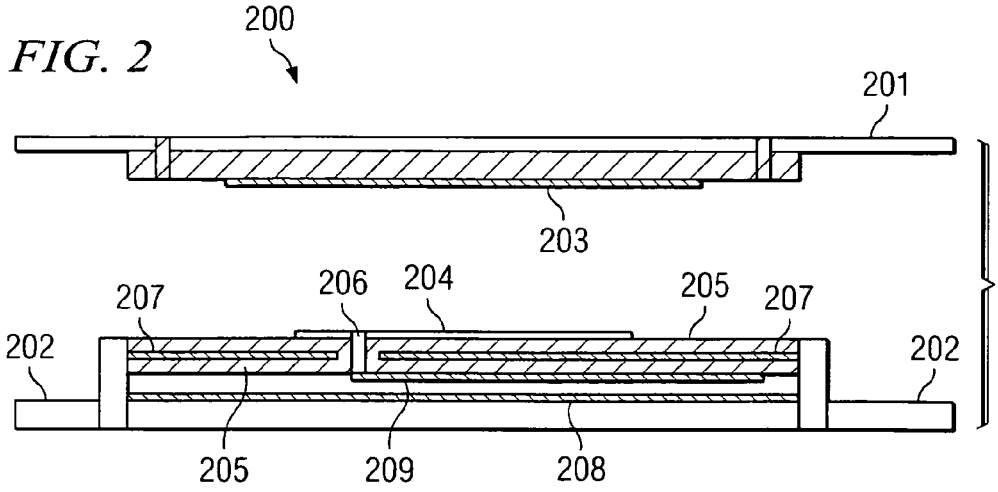
FIG. 2 is a fragmented diagrammatic side view of an a stacked patch antenna element embodiment.
Figure 3:
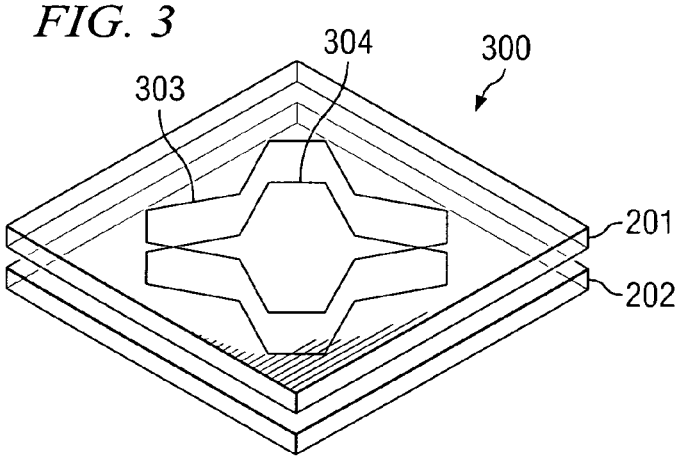
FIG. 3 is a fragmented diagrammatic perspective view of an embodiment of the stacked patch antenna of FIG. 2.
Figure 4:
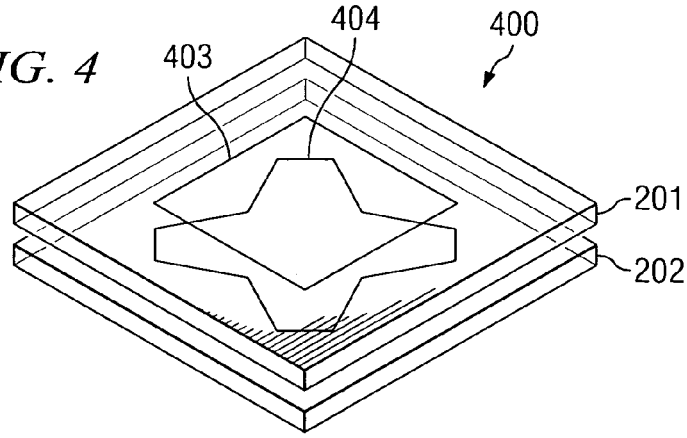
FIG. 4 is a fragmented diagrammatic perspective view of another embodiment of the stacked patch antenna of FIG. 2.

FIG. 2 is a diagrammatic side view of an a stacked patch antenna element configuration 200 disposed within a panel, between panel covers 201 and 202. FIGS. 3 and 4 are diagrammatic perspective views of embodiments 300 and 400 of stacked patch antenna 200 of FIG. 2. Antenna element 200 may be tuned by using parasitic element 203, spaced apart from feed element 204 at a predetermined height to provide higher gain, broaden the response band of element 200, and provide polarization purity. The height that parasitic element 203 is spaced above feed element 204 is preferably tuned to give a very broadband match. Preferably feed element 204 and the associated feed network are disposed on and/or embedded within the same Printed Circuit Board (PCB) structure 205 or the like. RF circuits and feed via 206 on the backside of feed antenna 204 are shielded by feed antenna ground plane 207, reducing cross-polarization and side lobe contribution. Feed of antenna element 200 may be simplified by avoiding soldering joints through integration of the feed network and at least a portion of the elements on PCB 205. Integrated feed via 206 on feed antenna is employed rather than an aperture feed mechanism to reduce backlobe radiation. Further backlobe radiation can be reduced by ground plane 208 placed at a distance from RF feed circuitry 209 on an underside of PCB 205. In accordance with embodiments of the present invention, each element 200 in an array may have at least two feeds (second feed not shown) to provide dual branch diversity. The feeds are isolated sufficiently to produce sufficient diversity advantages. In accordance with embodiments of the present invention elements can have any number of feeds for providing diversity.

The "cross-style" antenna element 300 of FIG. 3 may be used to reduce mutual couplings. Parasite antenna element 303 is approximately 1.3 times larger than feed antenna 304 to generate good dual resonance. Parasite antenna dimensions are approximately 0.29 wavelengths (λ) square in size with respect to a lowest operating frequency for antenna element 300. Parasitic element 303 is preferably spaced about 0.05λ to about 0.08λ from feed element 304 to optimize broadband behavior for good degenerated modes. With parasitic element 303 positioned at an over coupled location above feed element 304, stacked patch antenna element configuration 300 gives an increase in bandwidth on the order of 17 percent greater than that of the feed element alone.

Antenna element 400 of FIG. 4 has parasitic element 403 optimized to similar size as feed antenna 404 such as may be suggested by space constraints. Parasite antenna element is approximately 0.2λ square in size with respect to a lowest operating frequency for antenna element 400. Broadband behavior is optimized through the height of parasitic antenna element 403, disposed about 0.04 to 0.06λ above feed element 404 for good degenerated modes Parasite antenna 403 is not cross-shaped, and thereby provides increased bandwidth on the order of 26 percent greater than that of the feed element alone.

Figure 5:
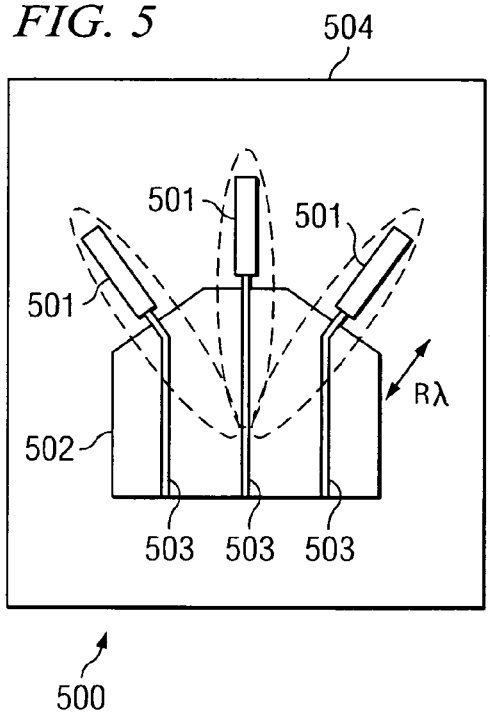
FIG. 5 is a fragmented diagrammatic front view of an embodiment of a multiple branch diversity monopole antenna element in accordance with the present invention.
Figure 6:
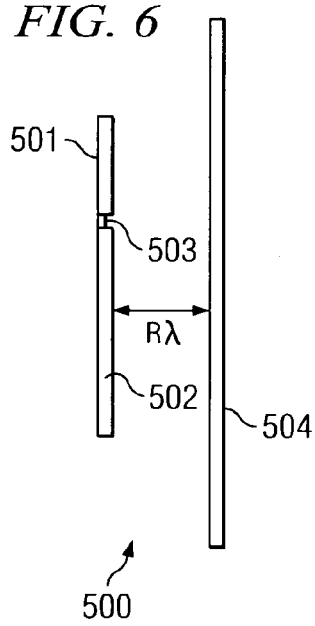
FIG. 6 is a fragmented diagrammatic side view of the antenna element embodiment of FIG. 5.
Figure 7:
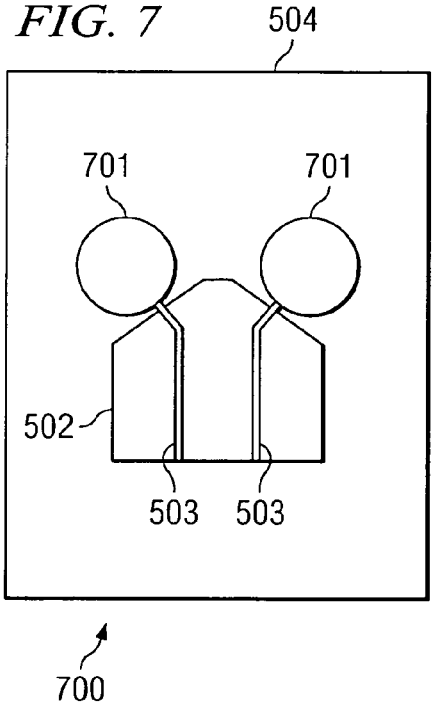
FIG. 7 is a fragmented diagrammatic front view of an alternative embodiment of a multiple branch diversity monopole antenna element in accordance with the present invention.
Figure 8:
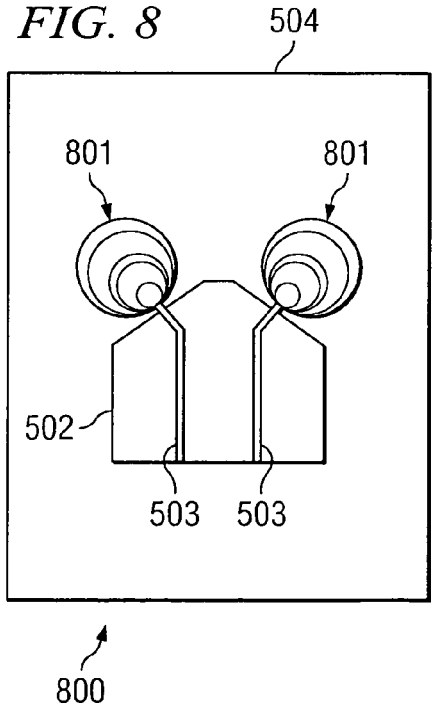
FIG. 8 is a fragmented diagrammatic front view of another alternative embodiment of a multiple branch diversity monopole antenna element in accordance with the present invention.
Figure 9:
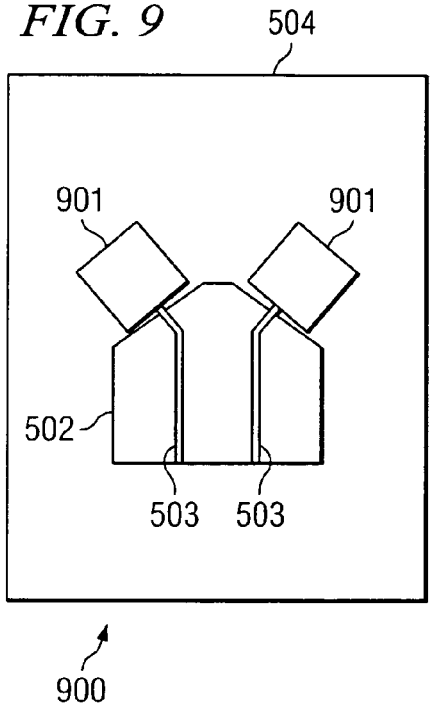
FIG. 9 is a fragmented diagrammatic front view of a third alternative embodiment of a multiple branch diversity monopole antenna element in accordance with the present invention.

Multiple branch diversity monopole element embodiment 500 is shown in FIG. 5. A side view of embodiment 500 is shown in FIG. 6. Alternative, embodiments 700, 800 and 900 of multiple branch diversity monopole antenna elements are shown in FIGS. 7, 8 and 9, respectively. Antenna element 500 employs monopoles 501 as feed elements. Monopoles 501 may be a dielectric loaded ceramic antenna element, or the like. Ground plane 502 forms a differential path for monopoles 501, resulting in dipole like characteristics for element 500. Ground plane 502 preferably supports feed network 503 and phase shifting circuitry (not shown) discussed below. Feed network 503 feeding a signal to monopoles 501 may take the form of microstrip lines defined on a dielectric (not shown) with ground plane 502 disposed on an opposite surface. Alternatively, monopoles 501 may be feed by a planar waveguide or the like used to guide the signal into the antenna elements. Use of microstrips or planar waveguides in the feed network facilitate providing a generally planer array. Monopoles 501, feed network 503 and ground plane 502 are preferably placed before reflector 504 at an optimum distance of Rλ, which may be about 0.25λ. Reflector 504 is also a ground plane. Since feed elements 501 can be dielectric loaded monopoles they can be small in size. Thus a small array can be implemented in accordance with embodiments 500, 700, 800 and 900. Planar disc monopole 701 may be utilized by embodiment 700 for ultra wideband characteristics. Multiple circular ring monopoles 801 may be used to provide antenna element 800 multi-band characteristics. Square plate monopoles 901 may be employed to provide antenna element 900 broadband characteristics. Square plate monopole 901 with shorting pins (not shown) at the corners to ground plane 502 may be used to generate additional lower order mode and broadband characteristics. Various configurations of embodiments 500, 700, 800 and 900 may be extended into an array to provide a multiple branch diversity antenna system. The three monopoles (501) of antenna element 500 may be fed to provide slant left, slant right and vertical polarization, whereas the two monopoles of elements 700, 800 and 900 (monopoles 701, 801 and 901, respectively) may be fed to provide slant left and slant right polarizations. However, embodiments of elements 500, 700, 800 and 900 may employ fewer or more monopoles 501, 701, 801 or 901 than shown to provide various polarizations.

Figure 10:
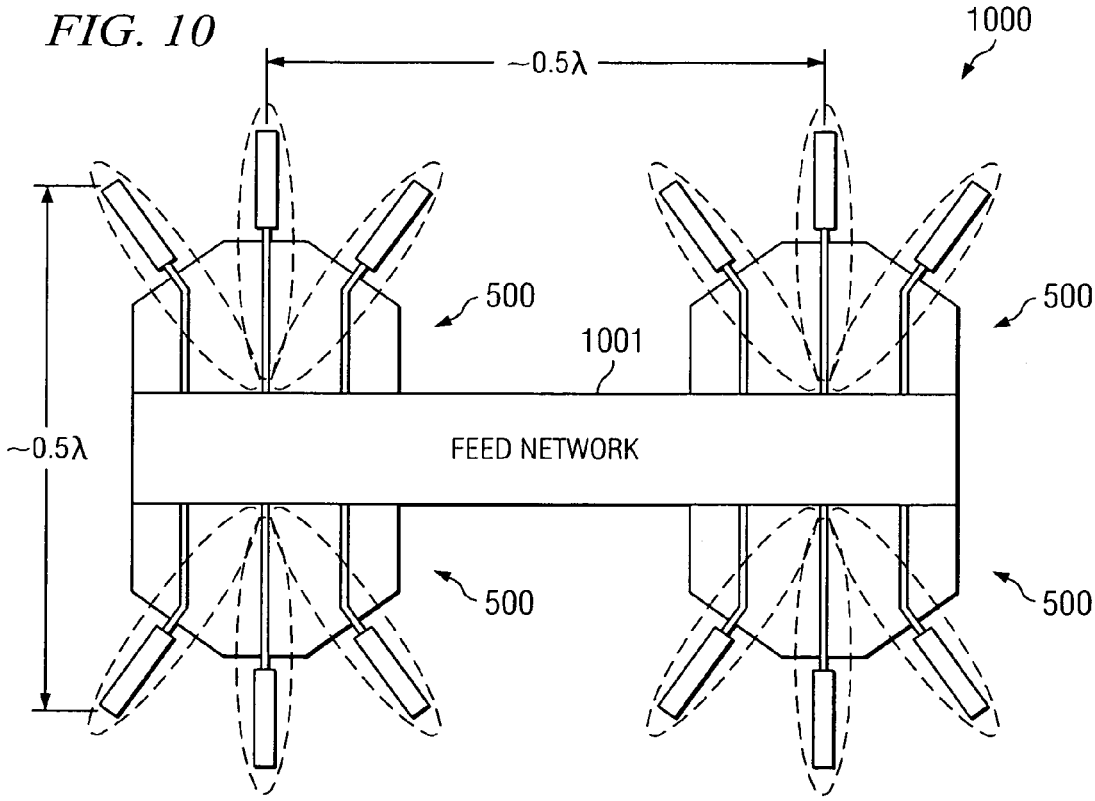
FIG. 10 is a fragmented diagrammatic front view of an embodiment of an antenna array of multiple tiled multiple branch diversity monopole antenna elements of FIG. 5.

Multiple ones of element 500 can be tiled into an array, such as array 1000 of FIG. 10. Four elements (500) are shown in FIG. 10 but any number of elements may be tiled into an array, as indicated by the ellipses to the right and below the illustrated elements. Elements 500 may be spaced appropriately for providing phased array beam forming as desired, such as spaced one-half a wavelength from each other. That will provide an ability to produce a number of independent beams with various independent characteristics including polarity diversity, various widths, various angles and the like from the array. Elements 500 are preferably supported by feed network 1001, which may be similar to feed network 503 described above.

Figure 11:
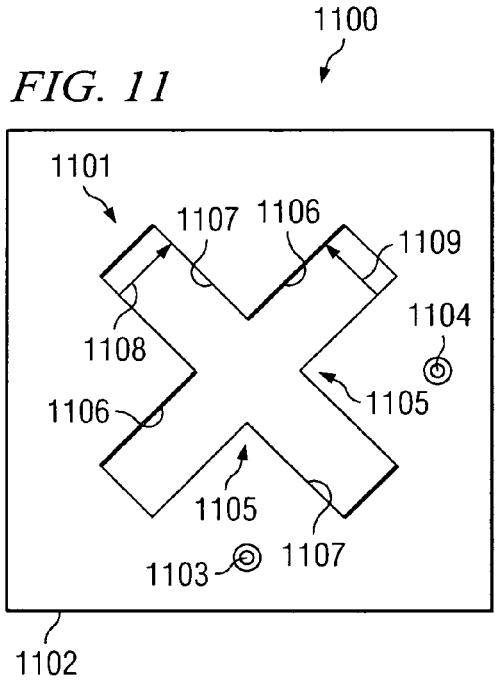
FIG. 11 is a fragmented diagrammatic front view of an embodiment of an antenna element providing branch diversity using integrated magnetic and electric dipoles in accordance with the present invention.
Figure 12:
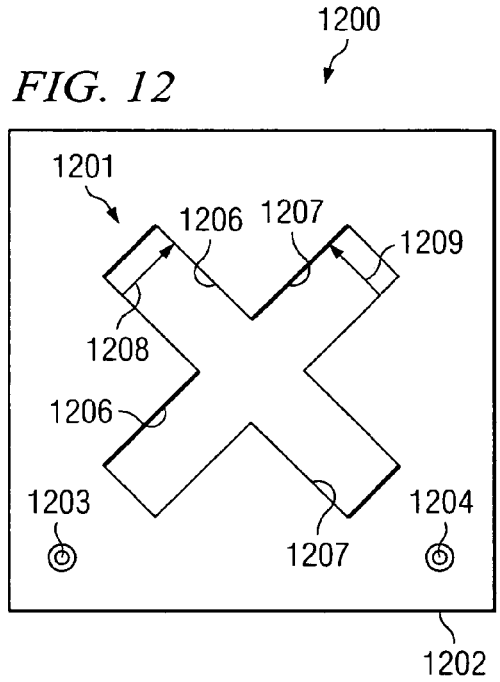
FIG. 12 is a fragmented diagrammatic front view of an embodiment of an antenna element providing branch diversity using integrated magnetic dipoles and electric monopoles in accordance with the present invention.

FIGS. 11 and 12 show diagrammatic illustrations of embodiments of slot integrated patch antenna elements 1100 and 1200 for four branch diversity. The slot integrated patch antenna elements 1100 and 1200 have X-shaped slot 1101 or 1201 cut in electric conductor 1102 or 1202, to provide a slot antenna element while electric conductor 1102 or 1202 forms a patch antenna element. With attention directed specifically to FIG. 11, patch feeds 1103 and 1104 for slot integrated patch antenna element 1100 may be placed generally aligned with intersection 1105 of X-shaped slot 1101. The slot feeds for slot integrated patch antenna element 1100 are shown by arrows 1108 and 1109. Turning now to FIG. 12, patch feeds 1203 and 1204 for slot integrated patch antenna element 1200 may be placed generally aligned with each slot 1206 and 1207 of X-shaped slot 1201. The slot feeds for slot integrated patch antenna elements 1200 are shown by arrows 1208 and 1209. In each embodiment of slot integrated patch antenna elements 1100 and 1200, feeds 1103, and 1104 or 1203 or 1204, respectively provide two branch diversity through orthogonal polarizations. Slots 1106 and 1107 or 1206 or 1207 defined in electric conductor 1102 or 1202 provide magnetic fields, resulting in two orthogonal beam branches for each of the two original beam diversity branches thus providing four branch (or beam) diversity. Elements 1100 or 1200 can be tiled in an array. In such an array, each feed to the antenna can be controlled to form various scanning beams.

Figure 13:
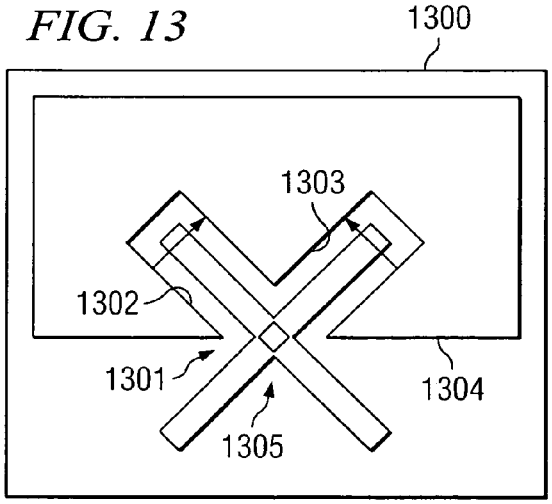
FIG. 13 is a fragmented diagrammatic front view of an embodiment of an antenna array of antenna elements providing branch diversity using integrated magnetic and electric dipoles of FIG. 11.
Figure 14:
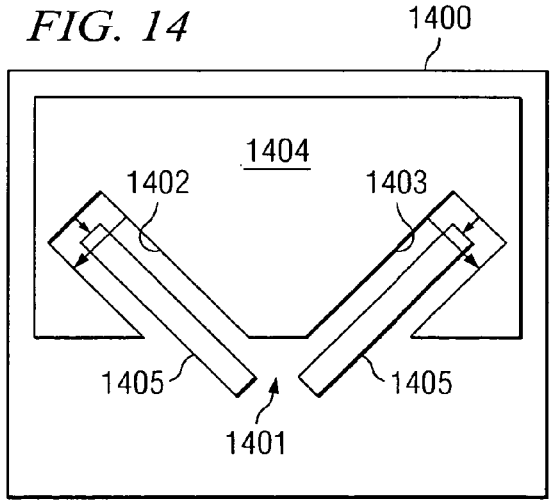
FIG. 14 is a fragmented diagrammatic front view of an embodiment of an antenna array of antenna elements providing branch diversity using integrated magnetic dipoles and electric monopoles of FIG. 12.

FIGS. 13 and 14 illustrate antenna elements 1300 and 1400 providing branch diversity using integrated magnetic and electric dipoles. Magnetic dual branch diversity antenna 1301 or 1401 is provided by slots 1302 and 1303 or 1402 and 1403 in the electrical conductor boundary 1304 or 1404. Elements 1300 and 1400 are fed close to an edge of one end of slots 1302, 1303, 1402 or 1403 as shown by the arrows in FIGS. 13 and 14. With attention directed to FIG. 13, four beams providing four branch diversity may be obtained by integrating magnetic slot antenna 1301 with cross shaped electric dipoles 1305 within the same area. Alternatively, as shown in FIG. 14, four beams providing four branch diversity may be obtained by integrating magnetic slot antenna 1401 with respective electric monopole 1405, using a bottom feed. Element 1400 may use an electric monopole element that is half the length of that used by element 1300, saving, space and weight. Since the E-field and the B-fields of grounded material 1304 or 1404 have differently polarized beams diversity is achieved between the beams produced by the magnetic dipoles and the electric dipoles of an element (1300 or 1400). Further, the beam patterns generated by magnetic antennas 1301 or 1401 will differ from the beam patterns generated by electric dipoles 1305 or 1405, providing further diversity.

Figure 15:
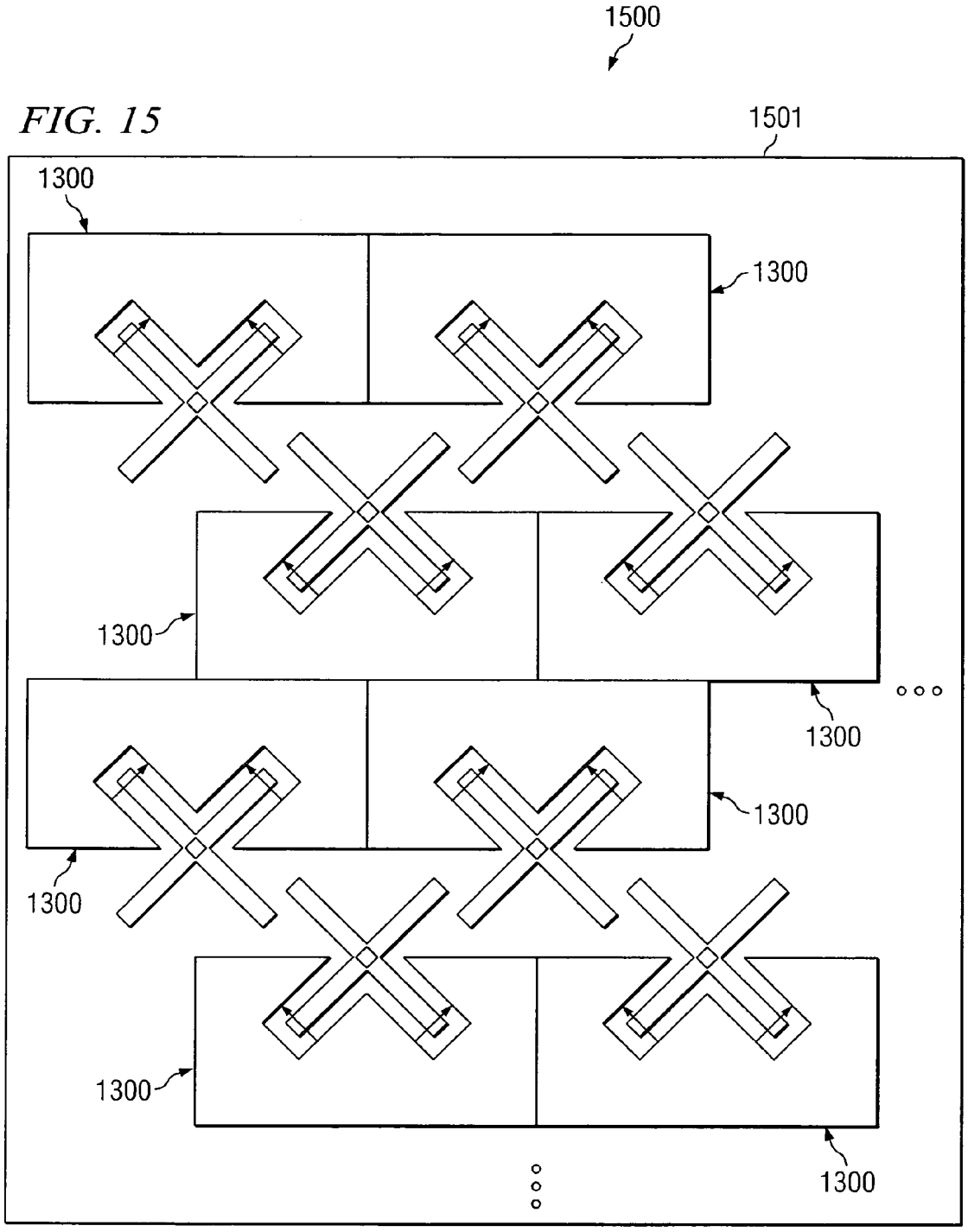
FIG. 15 is a diagrammatic illustration of an embodiment of a slot integrated patch antenna element for four branch diversity.
Figure 16:
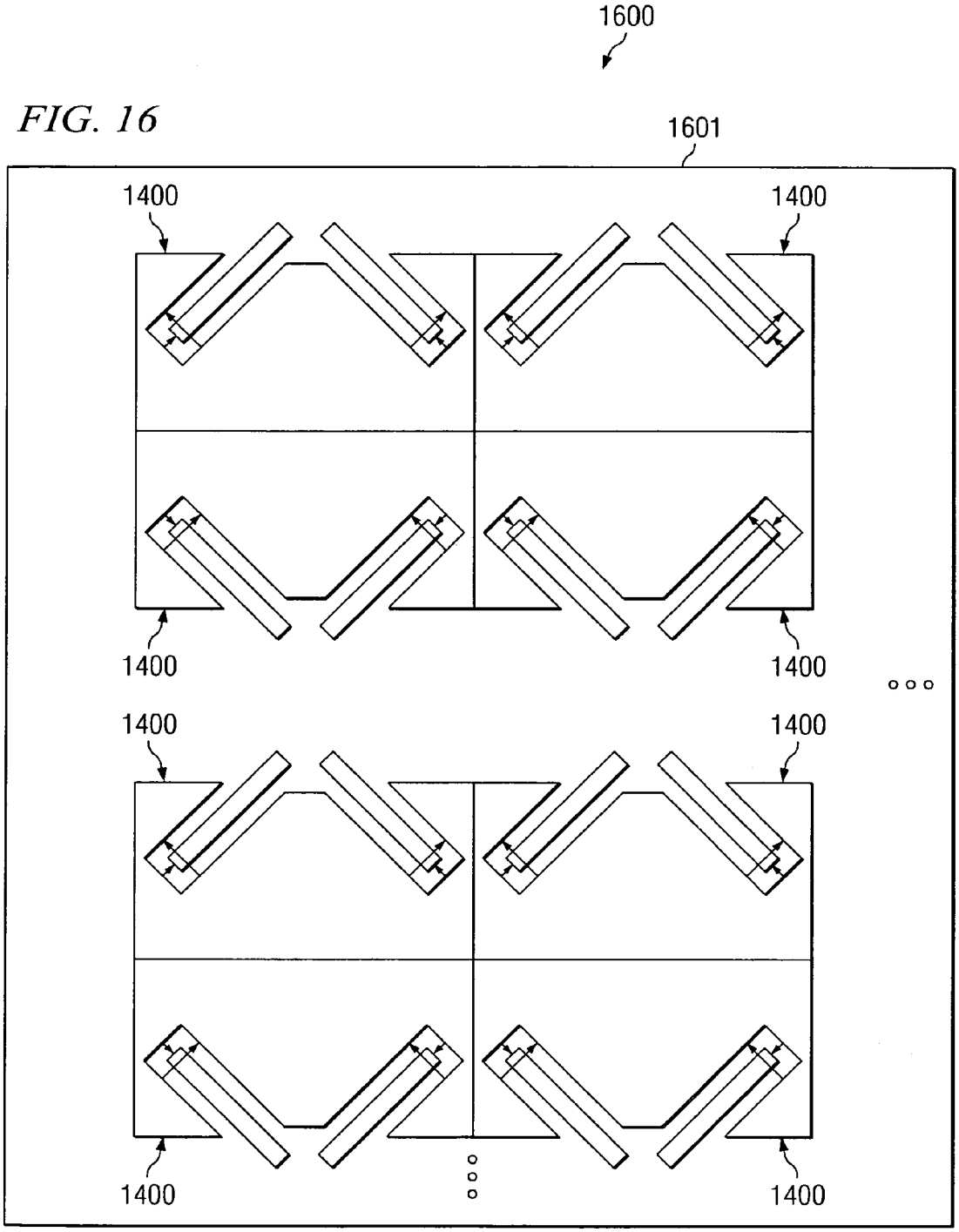
FIG. 16 is a diagrammatic illustration of another embodiment of a slot integrated patch antenna element for four branch diversity.

As shown in FIGS. 15 and 16 respectively, the antenna elements 1300 or 1400 may be tiled to form an antenna array providing four branch diversity systems 1500 and 1600. Preferably, a reflector plane 1501 or 1601, or the like, is used in arrays 1500 and 1600 to make direct the beams, particularly as the beams provided by elements 1300 or 1400 may be somewhat omnidirectional. Reflector plane 1501 or 1601 is preferably placed an optimum distance, R$\lambda$, from the plane of antenna elements 1300 and 1400.

Figure 17:
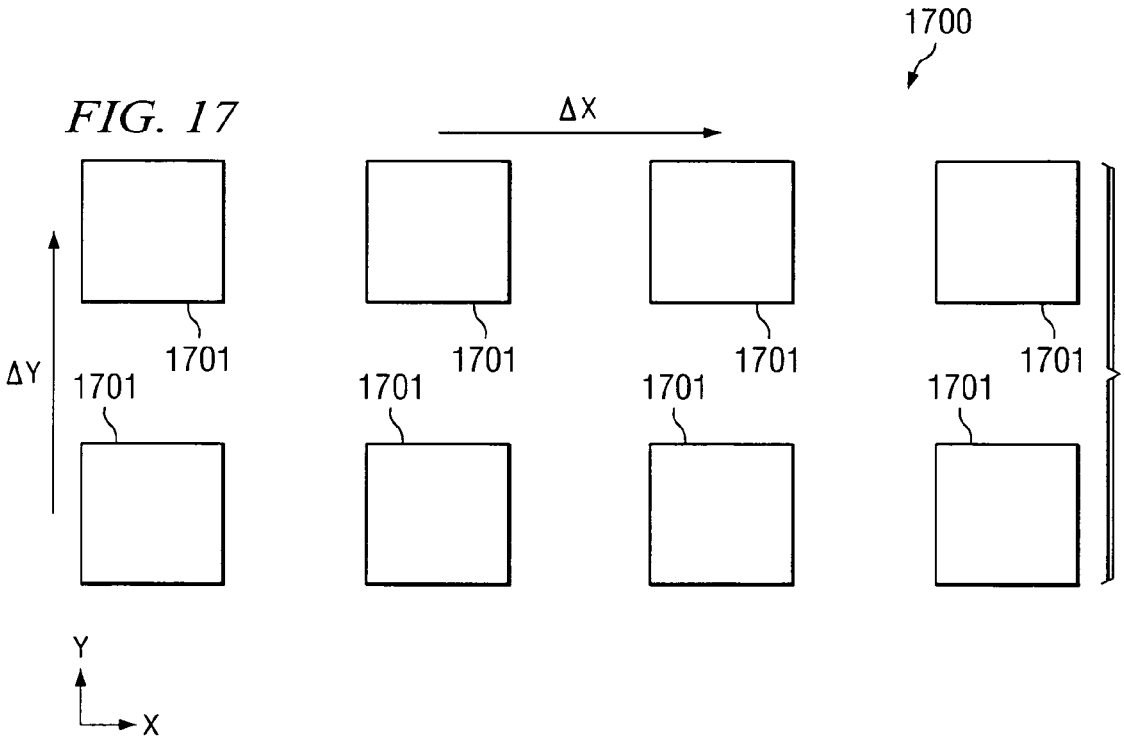
FIG. 17 is a diagrammatic illustration of spacing of array elements.

As generally illustrated in FIG. 17, spacing of array 1700 elements 1701 in $\Delta Y$ and $\Delta X$ is preferably optimized for scanning angle and gain in accordance with aspects of the present invention. For example $\Delta X$ may primarily be optimized for optimum +/− 45 degree scan angles to approximately 0.43$\lambda$ spacing and to provide optimum gain in those directions. However, larger $\Delta X$ or $\Delta Y$ spacing may provide higher gain. Thus, as a further example, $\Delta Y$ may be optimized primarily to improve gain of the array, but scan angle may be limited if $\Delta X$ or $\Delta Y$ spacing is too large.

Figure 18:
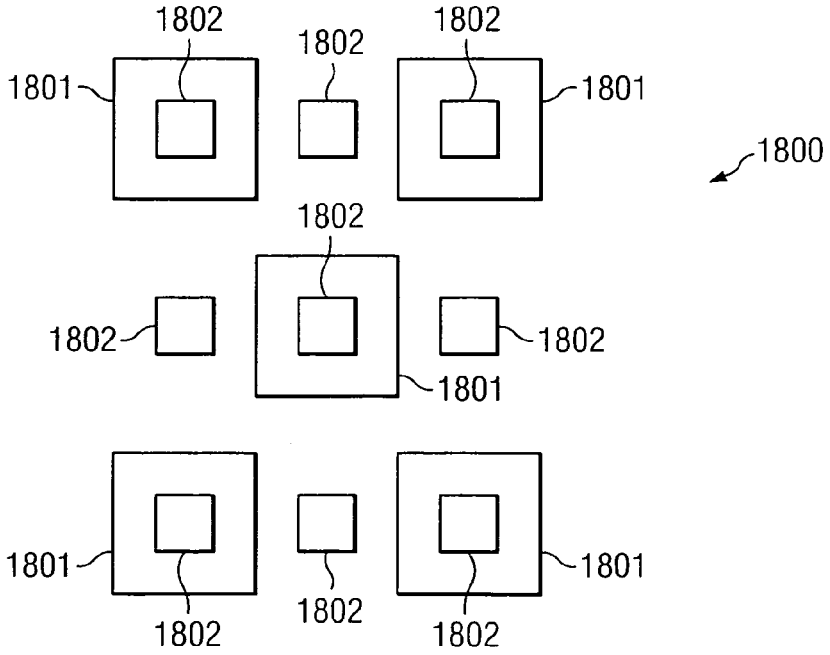
FIG. 18 is a diagrammatic illustration of an embodiment of interleaving of array elements for various bandwidths.
Figure 19:
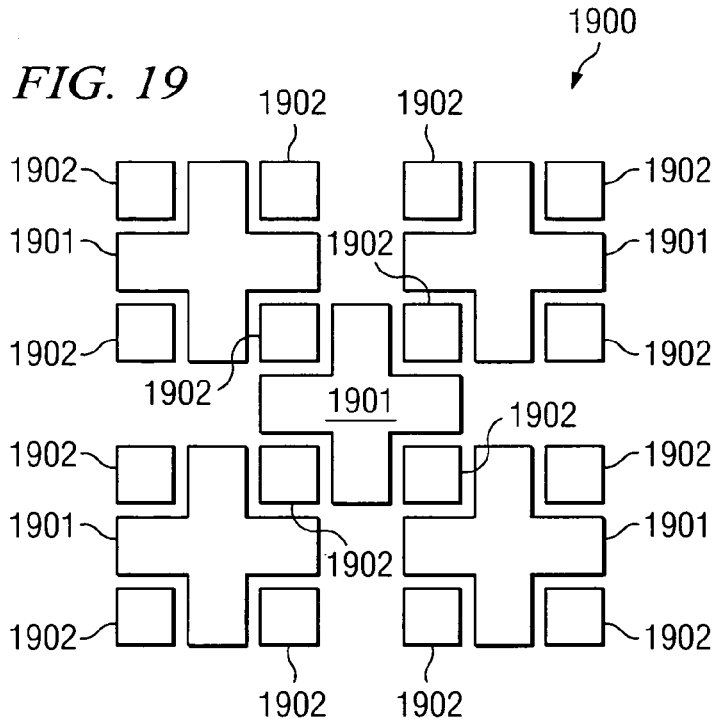
FIG. 19 is a diagrammatic illustration of another embodiment of interleaving of array elements for various bandwidths.

FIGS. 18 and 19 depict arrays 1800 and 1900 employing aperture sharing in accordance with the present invention. However, inter-element orientations for dual band array variations 1800 and 1900 provide independent radiation pattern characteristics on bands for elements 1801 and 1802 or 1901 and 1902, respectively. With attention directed specifically to FIG. 18 larger patches 1801 represent lower frequency elements and smaller patches 1802 represent higher frequency elements. Array 1800 employs five low frequency elements 1801, and within the space occupied by these five low frequency elements higher frequency elements 1802 are tiled or interspersed such that all of elements 1801 and 1802 are sharing the same aperture, possibly employing different radiation patterns. Similarly, in FIG. 19 cross-shaped antenna elements 1901 have smaller higher frequency elements 1902 embedded within their cross-shapes such that all of elements 1901 and 1902 are sharing the same aperture, possibly employing different radiation patterns.

Figure 20:
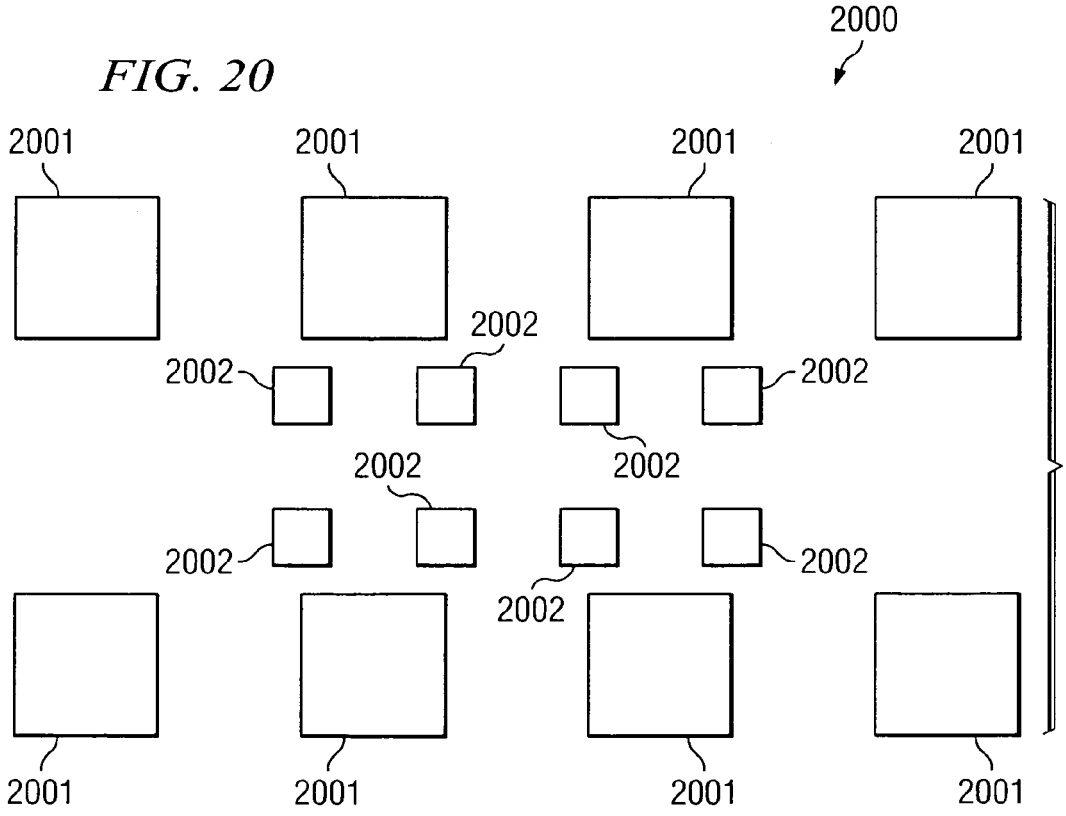
FIG. 20 is a diagrammatic illustration of a third embodiment of interleaving of array elements for various bandwidths.

FIG. 20 depicts an embodiment of array 2000 providing aperture sharing with an ability to have similar radiation pattern characteristics on both bands. In the illustrated embodiment of array 2000 four larger low frequency elements 2001 are disposed along two outside edges of the array, and smaller high frequency elements 2002 are disposed within/between the two rows of low frequency elements 2001. In dual band array 2000 with, for example, a frequency ratio of approximately 2:1 between the bands, an optimal $\Delta Y$ spacing of approximately 0.65$\lambda$ may be utilized for both higher and lower frequency elements if spacing of the lower frequency band elements provides sufficient spacing.

Figure 21:
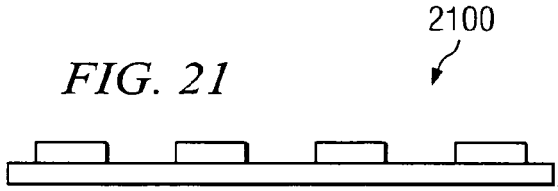
FIG. 21 is a diagrammatic side view of an embodiment of a planer array panel.
Figure 22:
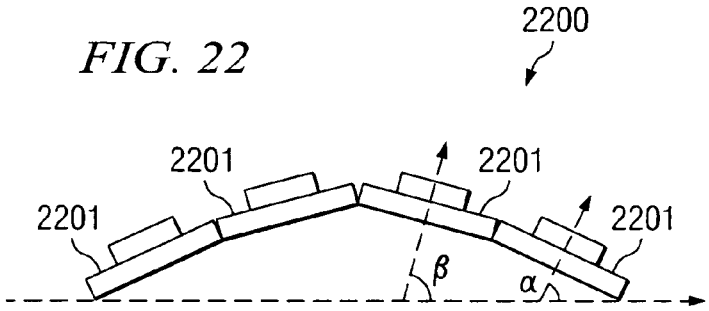
FIG. 22 is a diagrammatic side view of an embodiment of a curved array panel.
Figure 23:
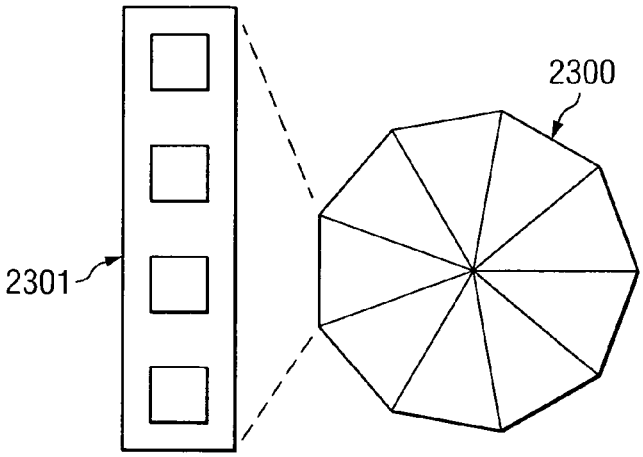
FIG. 23 is a diagrammatic top view of an embodiment of a cylindrical array with a front view of an embodiment of a planar panel used to make up the cylindrical array.

As depicted in FIGS. 21, 22 and 23 arrays 2100, 2200 or 2300 may be implemented on a flat structure (2100), on a curved structure (2200), or in a cylindrical structure (2300) in accordance with the present invention. This may be accomplished by referencing elements on a planar, curved or cylindrical surface or as shown in FIGS. 22 and 23, array panels 2201 or 2301 can be used to form a curved array 2200 or a cylindrical array 2300. Likewise spherical arrays could also be formed using array panels. Beam characteristics and direction may be determined by switching RF signals to various ones of array panels. Curved surfaces of arrays 2200 and 2300 preferably increase the scan angle of the whole array. Alternatively, the scan angle of an array panel may be increased by using a star topology feed network, such as by distributing an RF feed at the center of an array structure to output nodes which are situated around this center. Through use of a star topology feed network the array panels may be laid out in a generally cylindrical manner to provide a cylindrical array that scans 360 degrees. Each panel may also employ individual phase shifters within diversity branch feeds to provide further up-tilt or down-tilt beams. As one of ordinary skill in the art will appreciate an array may be disposed on surfaces of any number of shapes including, by way of example, the faces of spherical or hemispherical structures.

Figure 24:
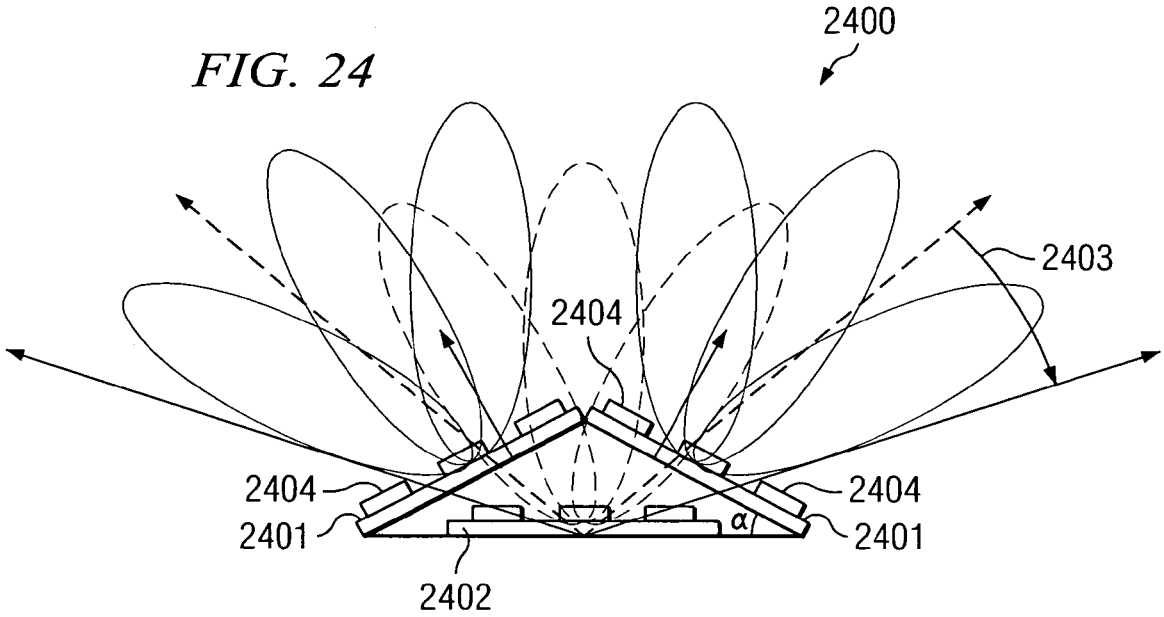
FIG. 24 is a diagrammatic illustration contrasting the scan angles of a planar array panel and two angularly disposed array panels.

As shown by the beam patterns depicted in FIG. 24 angularly disposed array faces 2400, similar to the faces illustrated in FIG. 23 for cylindrical array 2300, may enhance scan angle of an array, see the increased scan angle depicted by arc 2403. Thus, to reduce the number of elements necessary for an array, panels 2401 may be implemented in a triangular arrangement to increase the scan angle compared to a single planar array 2402. Each panel 2401 may have various column and rows of elements 2404. The angle of disposition of the array faces, $\alpha$, may determine the maximum scan angle or field of view for an array.

Figure 25:
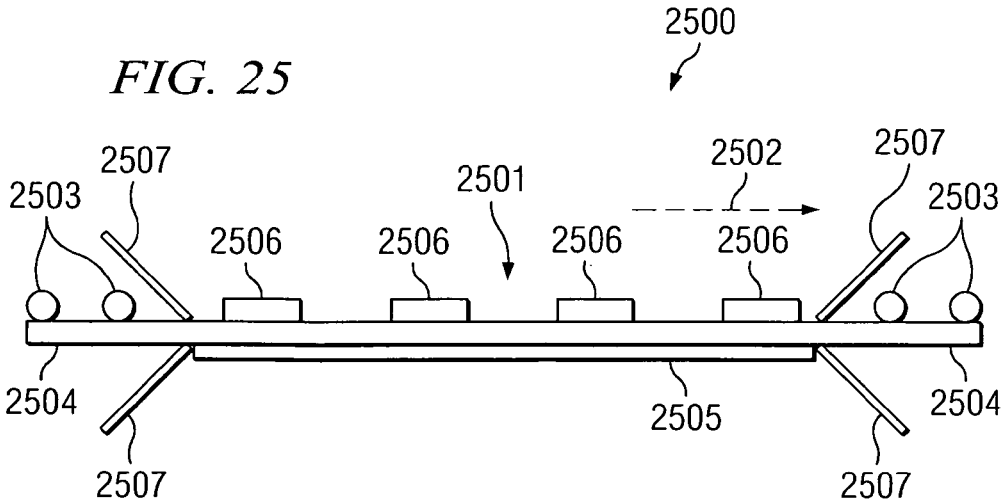
FIG. 25 is a diagrammatic side view of an embodiment of a planer array panel employing directors and angled reflectors.

The scanning angle of an array may be extended by using array configuration 2500, diagrammatically shown in FIG. 25. Conventionally, radiation along the plane of an array is a null field. However, in accordance with the present invention, radiation characteristics towards this plane may be increased. When scanning toward an angle along the face of array 2501, see arrow 2502, resonant structures 2503, for example dipole elements, may be used to act as directors to guide fields toward such an acute angle. Structures 2503 may be passive or active. A feed network will provide relevant signals to active structures, but not to passive structures. Dielectric PCB 2504 supporting antenna elements 2506 preferably extends to support directors 2503. However, ground plane 2505, as may be present to support field performance of patch antenna elements 2506, preferably does not extend beyond patch elements 2506 to director structures 2503. Resultantly, ground plane 2505 may form a reflector for the directors, to aid in steering beams generally along the plane of the antenna array. This would provide an edge-fired or end-fired antenna array. Additionally or alternatively, angular reflector plates 2507 may be placed at a position such as at the termination of the ground plane 2505, to provide higher gain of the edge-fired or end-fired antenna array. Reflector plates 2507 may also serve to optimize and tuned beam widths of the array panel formed by elements 2506 and 2503. A preferred angle of the reflector plate for maximal gain may be 45 degrees relative to the plane of the PCB 2504 and the preferred length of reflector plates 2507 may be about 0.25λ.

Figure 26:
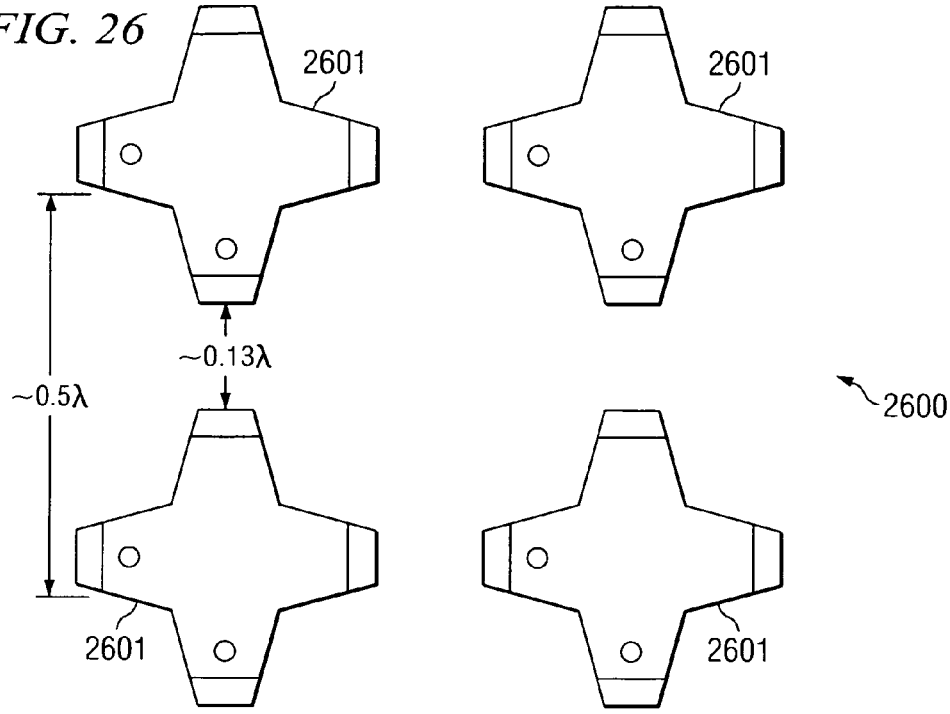
FIG. 26 diagrammatically shows an embodiment of element orientation within an array.
Figure 27:
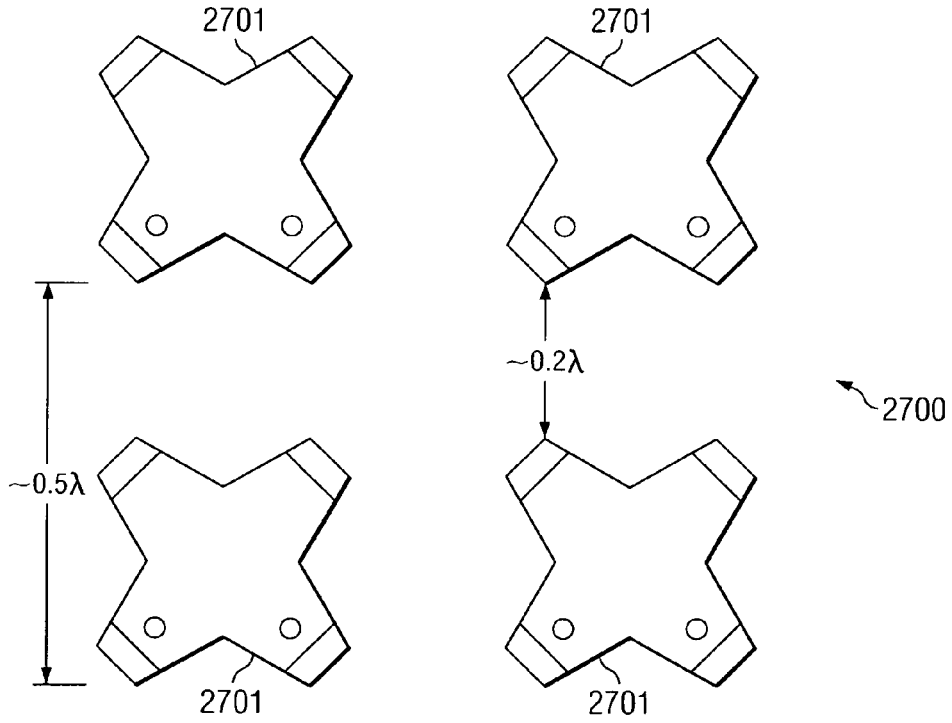
FIG. 27 diagrammatically shows another embodiment of element orientation within an array.

As shown in FIGS. 26 and 27 element orientation within arrays 2600 and 2700 may vary between arrays. Each of configurations 2600 and 2700 provides dual branch diversity. In array 2600 of FIG. 26 with "upright" oriented patch arrangement of cross elements 2601, the edge to edge spacing between the elements will be closer than in array 2700, such as at 0.13λ to provide desired 0.5λ element to element spacing. However, array 2700 of FIG. 27 may result in a smaller array while providing the desired 0.5λ spacing. Preferably, at 0.5λ inter element spacing, edge to edge distance between elements is also relaxed, such as to 0.2λ. Inter-element spacing in array 2700 may be reduced due to reductions in mutual coupling of cross shaped antenna elements 2701 (discussed below in relation to FIG. 31), without severe performance degradation. Further, the configuration of array 2700 may avoid unbalanced mutual coupling, thus avoiding different radiation patterns between branches. Finally, 45 degree slant right and slant left polarizations provided by array 2700 may provide better diversity performance in some situations.

Figure 28:
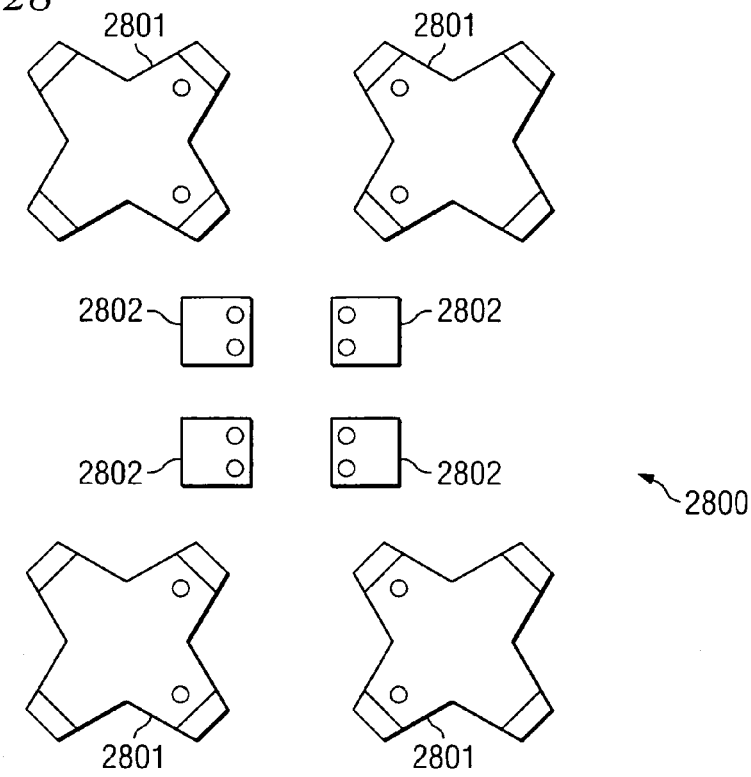
FIG. 28 diagrammatically shows an embodiment of element orientation within an interleaved array.
Figure 29:
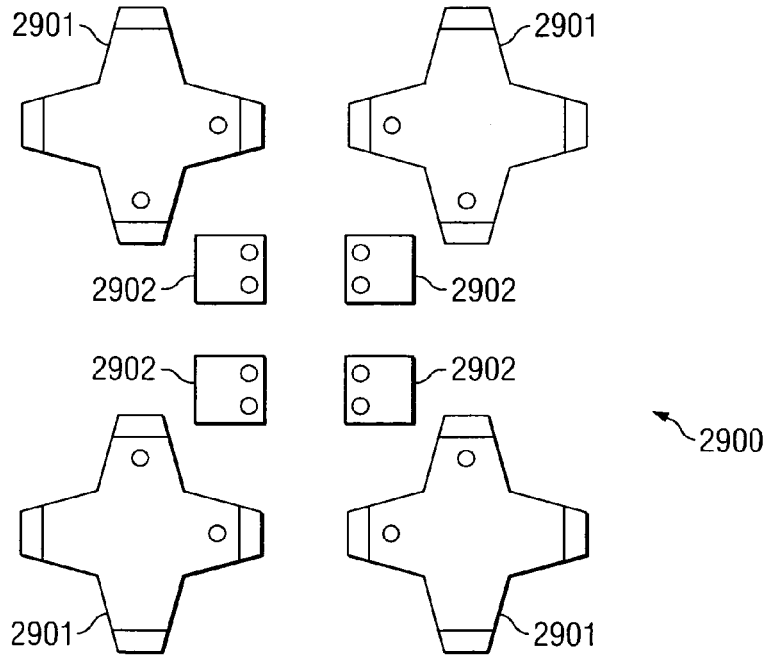
FIG. 29 diagrammatically shows another embodiment of element orientation within an interleaved array.

Turning to FIGS. 28 and 29, interleaved arrays 2800 and 2900 are shown. As shown in FIG. 28, larger lower frequency cross-shaped elements 2801 can be rotated to relax spacing requirements of embedded higher frequency elements 2802 in contrast to the spacing of elements 2901 and 2902 in array 2900 of FIG. 29. Rotated elements 2801 and 2802 may also provide greater isolation between the different band elements. Additionally, radiation pattern characteristics of array 2900 may not be as desirable as the radiation characteristics of array 2800 in some circumstances.

Figure 30:
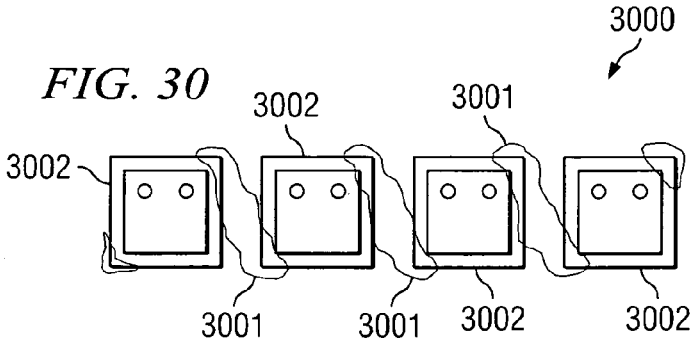
FIG. 30 is a diagrammatic illustration of mutual coupling of an embodiment of square antenna elements in an array.
Figure 31:
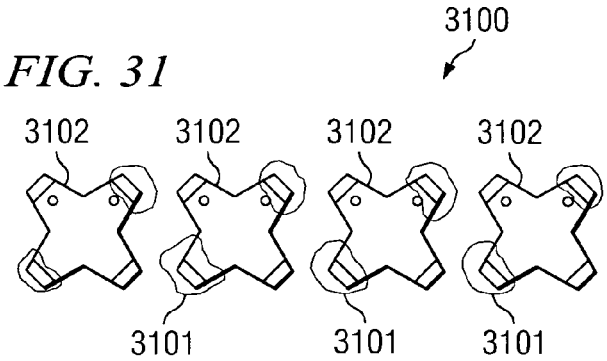
FIG. 31 is a diagrammatic illustration of mutual coupling of an embodiment of cross-type antenna elements in an array.

FIGS. 30 and 31 illustrate mutual coupling between closely placed patch antenna elements. FIG. 30 shows the strong mutual coupling 3001 of square patch antenna elements 3002 while FIG. 31 shows the relatively weak mutual coupling 3101 between rotated cross-shaped antenna elements 3102. Thus, cross-shaped elements reduce mutual coupling between elements as shown in FIG. 31, while allowing more space for upper band elements, as shown in FIG. 28, without sacrificing performance, achieving relatively high gains with symmetrical beam patterns. Further, use of cross-shaped elements reduce antenna element size due to longer effective current paths, resulting in better mutual coupling characteristics while allowing smaller arrays to be provided.

Figure 32:
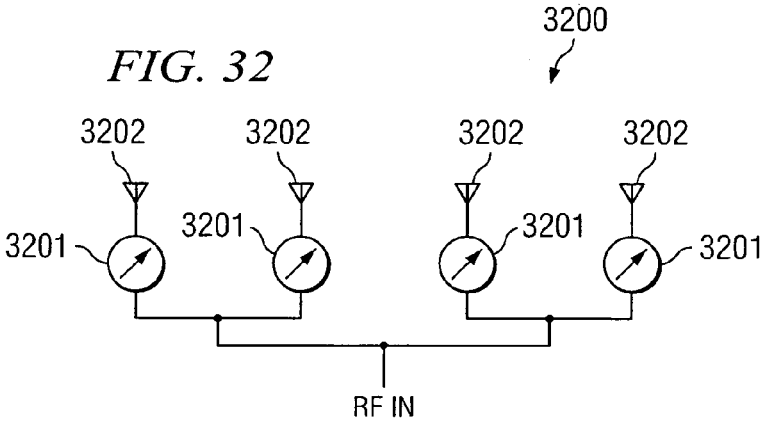
FIG. 32 is a diagrammatic schematic of a feed network in accordance with an embodiment of the present invention.
Figure 33:
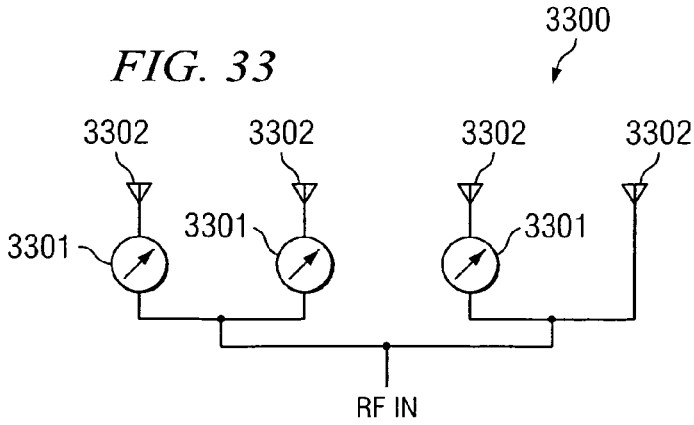
FIG. 33 is a diagrammatic schematic of a feed network in accordance with another embodiment of the present invention.

The present systems and methods may employ at least a dual band scanning array with at least dual beams in each band. Preferably, each beam is independently controlled with its respective phase shifting circuits. Alternatively, dual beams of the same band shares a similar set of phase shifting circuits. The present invention may employ a phase shifter network employing discrete phase shifts, such as zero, 90, 180 and 270 degrees phase shifts. However, the present invention is not limited to these particular discrete phase shifts and may alternatively employ other fixed phase shifts or continuous variation phase shifts. FIG. 32 is a simplified diagrammatic illustration of an embodiment of phase shifter deployment 3200 with four antennas of an array. In FIG. 32 one phase shifter 3201 is deployed in conjunction with each antenna element 3202. Preferably, a phase shifter is attached to each branch of the associated antenna element. Wilkinson power dividers or the like (not shown) may be used for isolation. The present invention preferably provides a dual band scanning array with at least dual beams in each band. Each beam may be independently controlled through its respective element's or elements' phase shifting circuits. Alternatively, dual beams of the same band may share a similar set of phase shifting circuits using a switch to switch between two antenna feeds. Also, to reduce the number of components, such as phase shifters and/or PIN diodes, used in an array the phase shifter arrangement shown in FIG. 33 may be employed in accordance with the present invention. In the layout embodiment illustrated in FIG. 33 one phase shifters 3301 is associated with each of three antenna elements 3302 of a branch, with fourth element 3303 providing an unshifted reference phase.

Figure 34:
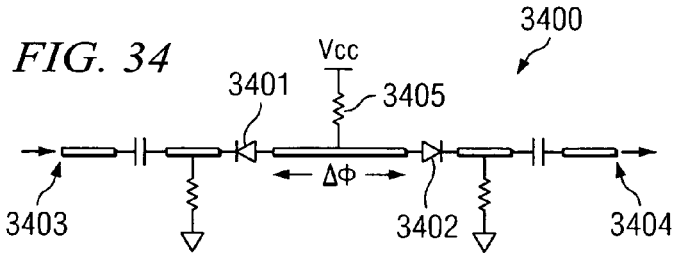
FIG. 34 is a diagrammatic schematic of an embodiment of a single branch phase shifter in accordance with the present invention.
Figure 35:
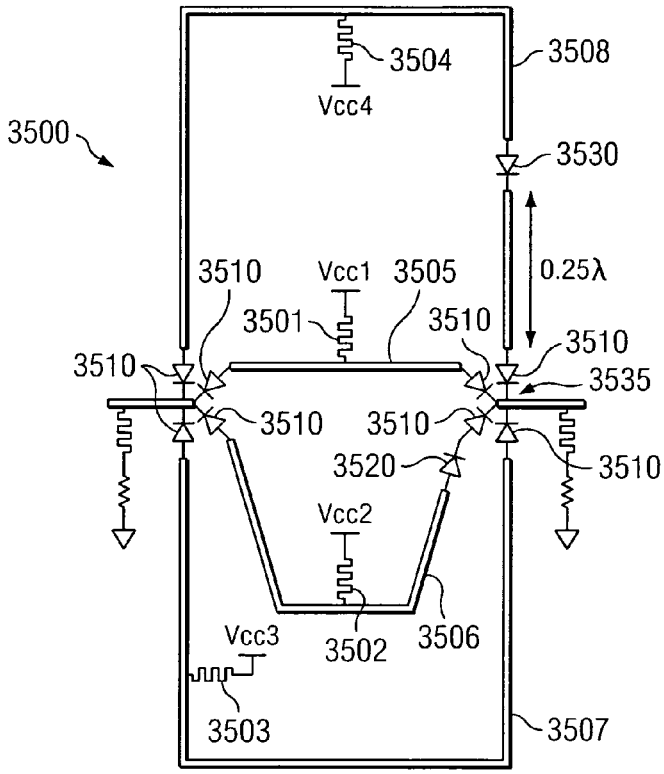
FIG. 35 is a diagrammatic schematic of an embodiment of a quad branch phase shifter in accordance with the present invention.
Figure 36:
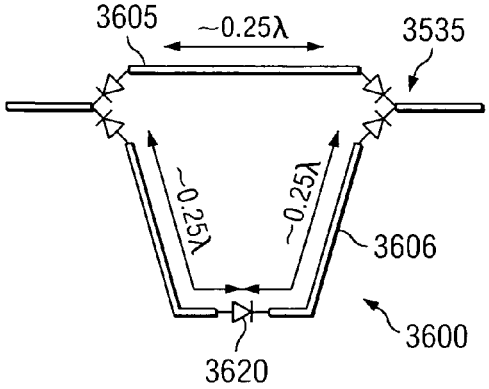
FIG. 36 is a diagrammatic schematic of an embodiment of a two branch phase shifter having improved isolation in accordance with the present invention.

FIGS. 34 and 36 show shifters that may be employed by the present invention in a true delay line phase shifter network. FIG. 34 shows a simplified schematic of single branch phase shifter 3400, FIG. 35 shows a simplified schematic of quad branch phase shifter 3500, and FIG. 36 shows embodiment of two branch phase shifter 3600 having improved isolation. The embodiment of single branch phase shifter 3400 shown in FIG. 34 uses two PIN diodes 3401 and 3402, in an opposite back-to-back configuration, to ensure isolation between input port 3403 and the output port 3404, inductor 3405 provides a Direct Current (DC) bias in the length ΔΦ. Length ΔΦ may be used to determines the amount of phase provided by phase shifter 3400. Diodes 3401 and 3402 give good isolation when bias is off. When bias on, diodes 3401 and 3402 facilitate good transmission characteristics.

In delay phase shifter 3500 of FIG. 35 meander line inductors 3501, 3502, 3503 and 3504 are used. Meander line inductors are similar to printed circuit transmission lines, but are very high in impedance. The line length of the meander line inductors 3501, 3502, 3503 and 3504 is preferably about 0.25 $\lambda_g$ (guided wavelength), so as to provide very high impedance at the end where it feeds to an RF line. That reduces the amount of losses on the RF lines. Four different line lengths, ΔΦs 3505, 3506, 3507 and 3508, in phase shifter 3500 provide four discrete phase shifts, preferably based around reference line length of zero phase shift line 3505. The illustrated embodiment of FIG. 35 is shown as calibrated to zero, 90, 180, and 270 degrees. Preferably, each line of phase shifter 3500 is isolated with back to back diodes 3510. When bias is provided to a particular branch, the PIN diodes in either direction are forward biased. However, the PIN diodes of the other branches, which are not meant to turn on, are reverse biased. This provides a very good isolation for the entire phase shifter system. Additional diode 3520 may be placed in 90 degree line 3506 to further ensure isolation. Second additional diode 3530 may be placed in 270 degree line 3508 at a distance of 0.25$\lambda_g$ from junction diodes 3535 to further insure isolation by providing an open short circuit at 0.25$\lambda_g$ from junction 3535.

As shown in FIG. 36, for the ΔΦ line length calibrated to zero degrees (3605), a line length of 0.25$\lambda_g$ may provide superior junction isolation, in which case additional diode 3620 placed in 90 degree line 3606 may alternatively be placed 0.25$\lambda_g$ from junction 3535 to provide better junction isolation. Further implementation of additional diodes on different ΔΦ lengths at intervals of 0.25$\lambda_g$ from junctions may be employed to further enhance junction isolation and reduce noise in a delay phase shifter, such as delay phase shifter 3500. When such diodes are biased on they provide another open circuit toward the junction side, providing better isolation and very broad band behavior. These additional diodes preferably prevent opposite phased power leakage cancellation between different branches and broaden operational bandwidth by canceling resonance effects in transmission paths. Resultantly transmission losses are also generally reduced throughout the entire phase shifter network. The phase shifter embodiment of FIG. 35, particularly enhanced with additional diodes as demonstrated in FIG. 36 enables use of inexpensive, somewhat lossy diodes while providing reasonable performance at higher frequencies.

Figure 37:
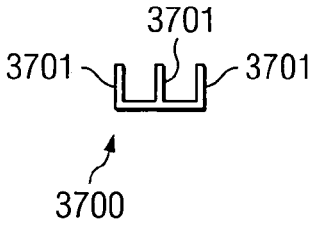
FIG. 37 (PRIOR ART)
FIG. 37 is an embodiment of a 45 degree reduced size phase shift line provided in accordance with the present invention.
Figure 38:
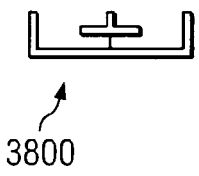
FIG. 38 is another embodiment of a 45 degree reduced size phase shift line provided in accordance with the present invention.
Figure 39A:
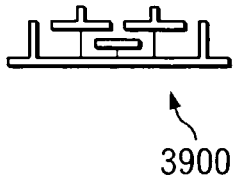
FIG. 39A is an embodiment of a 90 degree reduced size phase shift line provided in accordance with the present invention.
Figure 39B:
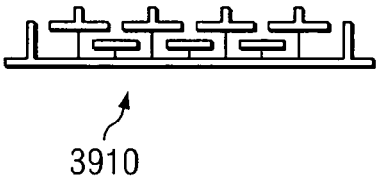
FIG. 39B is an embodiment of a 180 degree reduced size phase shift line provided in accordance with the present invention.
Figure 39C:
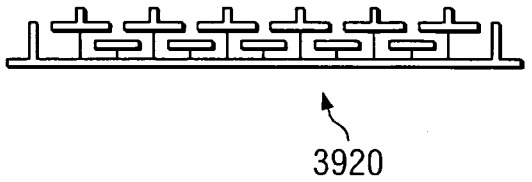
FIG. 39C is an embodiment of a 270 degree reduced size phase shift line provided in accordance with the present invention.

Transmission lines in phase shifters, such as those for 180 and 270 degree phase shifts in phase shifter 3500 of FIG. 35, can be quite long resulting in a large phase shift network. FIGS. 37, 38 and 39A illustrate a manner of reducing the phase path lengths, the physical length of the transmission lines, into very small equivalent circuits. As is known in the art and shown in FIG. 37 a 45 degree line can be reduced in size using three stubs 3701 to form reduced size phase shift line 3700. This reduced size phase shift line 3700 can be reshaped to provide reduced size 45 degree phase shift line 3800. Sections of these lines can be used to form various reduced sized switch line phase delay circuit. For example, two reduced size 45 degree phase shift lines 3800 can be combined and provided proper impedances to provide a reduced size 90 degree phase shift line 3900 of FIG. 39A. Stub impedances may be tuned for 50 Ω end to end, by way of example. Four reduced size 45 degree phase shift lines 3800 may be combined to provide 180 degree reduced size phase shift line 3910 of FIG. 39B, and six reduced size 45 degree phase shift lines 3800 may be combined to provide 270 degree reduced size phase shift line 3920 of FIG. 39C.

Figure 40A:
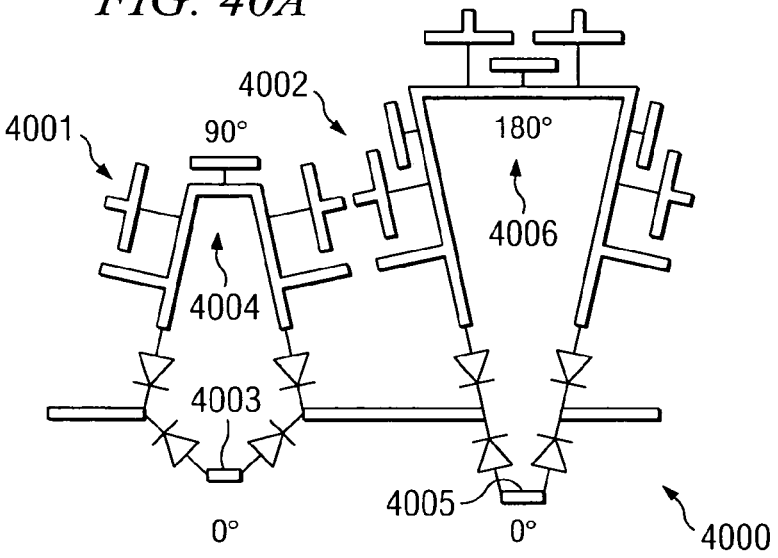
FIG. 40A is a diagrammatic schematic of an embodiment of a two branch phase employing the 90 and 180 degree reduced size phase shift lines of FIGS. 39A and 39B, in accordance with the present invention.
Figure 40B:
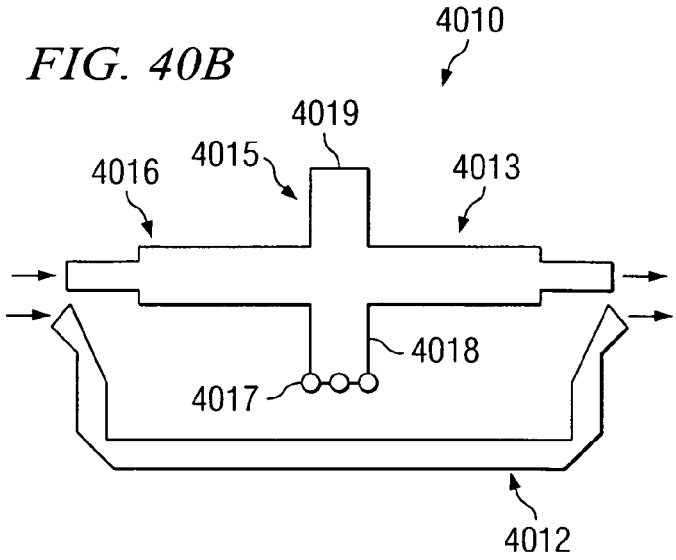
FIG. 40B is a diagrammatic schematic of an embodiment of an ultra-broadband 90 degree phase shifter having a phase reference line and a phase shifted line.
Figure 40C:
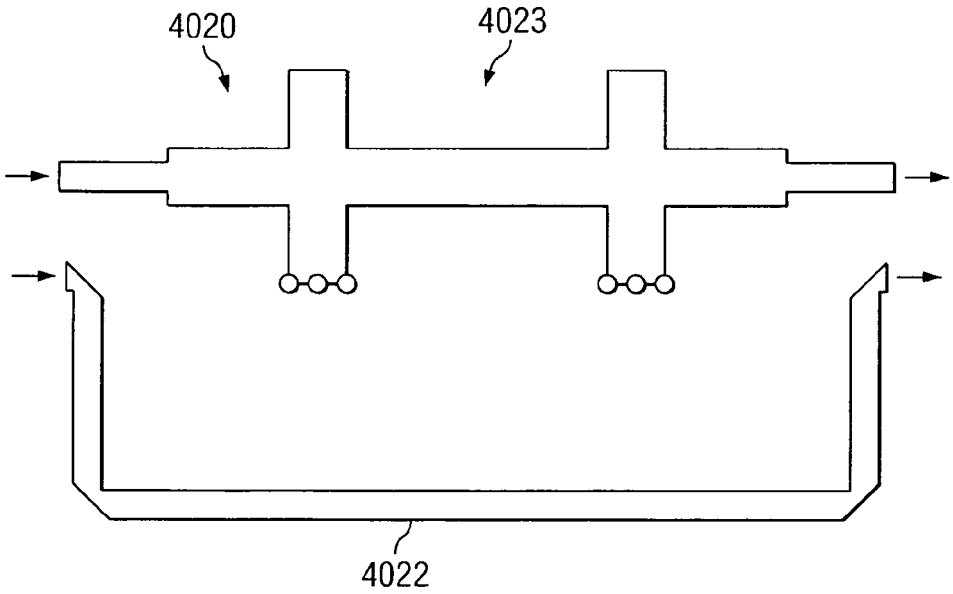
FIG. 40C is a diagrammatic schematic of an embodiment of an ultra-broadband 180 degree phase shifter having a phase reference line and a phase shifted line.
Figure 41:
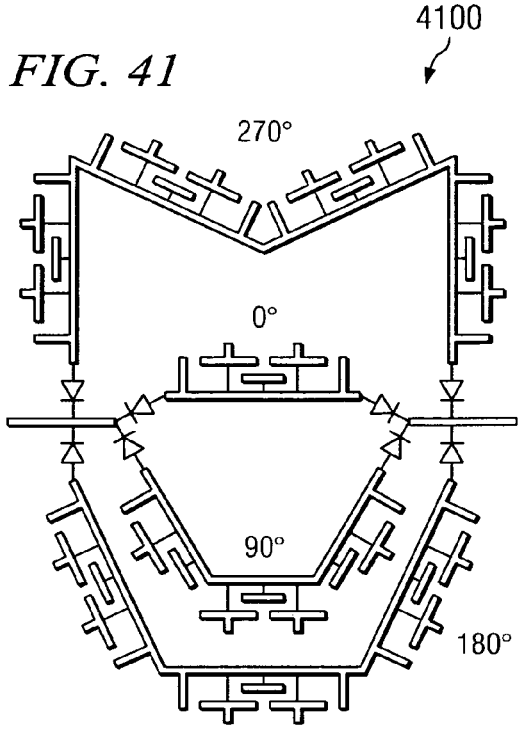
FIG. 41 is a diagrammatic schematic of an embodiment of a quad branch phase shifter employing the 90, 180, and 270 degree reduced size phase shift lines of FIGS. 39A, 39B and 39C, in accordance with the present invention.

Sections of reduced size phase shift lines 3800, 3900, 3910 and 3920 may be used to form various reduced sized switch line phase delay circuits, such as circuits 4000 and 4100 shown in FIGS. 40 and 41. Phase shifter circuit 4000 of FIG. 40A is made up of two phase shifters 4001 and 4002. Phase shifter 4001 has two branches, zero degree branch 4003 and 90 degree branch 4004. Zero degree branch 4003 does not make use of a reduced size phase shift line, whereas 90 degree branch 4004 employs two 45 degree reduced size phase shift lines (3800) to provide a 90 degree phase shift line similar to line 3900 described above. Phase shifter 4002 also has two branches, branch 4005 is a zero degree branch and branch 4006 is a 180 degree branch. As with phase shifter 4001 zero degree branch 4005 does not make use of a reduced size phase shift line. 180 degree branch 4006 employs four 45 degree reduced size phase shift lines (3800) to provide a 180 degree phase shift line similar to line 3910 described above. Phase shift network 4001 may provide phase shifts for zero, 90, 180 or 270 degrees. FIG. 41 shows reduced circuitry 4100 for a phase shifter, such as phase shifter 3500 of FIG. 35.

As is known in the art and shown in FIG. 40B an ultra-broadband 90 degree phase shifter circuit 4010, such as with a frequency ratio greater than two-to-one, may comprise a phase reference line 4012 which has a guided wavelength length corresponding to a phase length of 270 degrees and phase shifted line 4013 providing a 90 degrees broadband phase shift with respect to reference line 4012. Phase shifted line 4013 may comprise two orthogonal stubs 4015 and 4016 forming a "plus-sign shape" with one end 4018 of "vertical" stub 4015 shorted to ground by shorting pins 4017 while the other end (4019) is an open circuit. Preferably, by designing circuit 4010 at a center frequency of interest, for example 5.5 GHz, circuit 4010 may operate within +/−5 degrees of a 90 degrees phase shift such as to 3.3 GHz. As shown in FIG. 40C, a present inventive ultra-broadband 180 degree phase shifter circuit 4020 may comprise a phase reference line 4022 which has a guided wavelength length corresponding to a phase shift of 540 degrees and cascaded phase shifted line 4023 providing a 180 degrees broadband phase shift with respect to reference line 4022. Similarly, other inventive broadband phase shifters, such as a 270 degree broadband phase shifter, may be provided using a cascaded guided wavelength length reference line and corresponding cascaded phase shifted lines. Alternatively, reference phase lines 4012, 4022, or the like may be meandered to further reduce module size.

Figure 42:
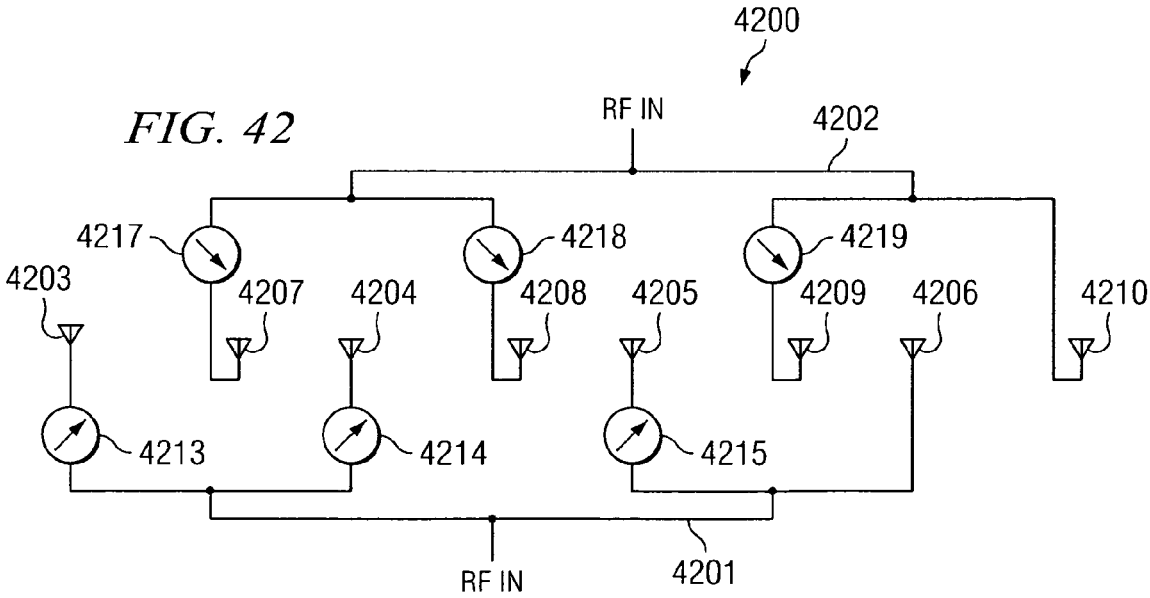
FIG. 42 is a diagrammatic schematic of a two branch feed network in accordance with an embodiment of the present invention.

FIG. 42 discloses feed network elements deployed in accordance with the present invention. Feed network 4200 shown in FIG. 42 is preferably disposed in array panels. Feed network 4200 employs dual branch interlaced feed for space optimization and can be implemented on microstrip lines, embedded striplines or the like on a PCB such as PCB 205/2504 discussed above. The illustrated embodiment of feed network 4200 shown in FIG. 42 has two RF feed branches, 4201 and 4202, integrated for a single or multi-band, dual branch array. Each RF feed, by way of example, feeds four groups of antenna elements, or columns. RF branch 4201 feeds antenna elements or columns 4203–4206, and RF branch 4202 feeds antenna elements or columns 4207–4210. Antennas or columns 4203–4205 and 4207–4209 each have associated phase shifters 4213–4215 and 4217–4219, respectively, with antenna elements or columns 4206 and 4210 acting as reference elements, without phase shifters.

Figure 43:
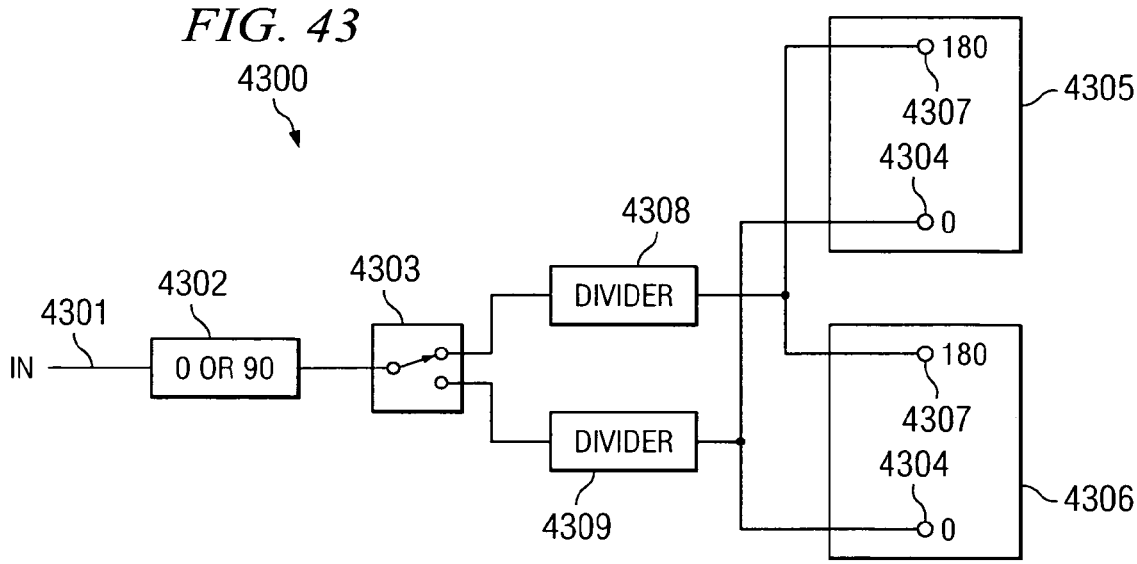
FIG. 43 is a diagrammatic schematic of a phase shift feed embodiment having a phase shifter and a switch in accordance with the present invention.

However, the number of phase shifters used in a feed network, such as feed network 4200, may be reduced through the use of phase shifters and branching out the signal using a switch by implementing dual branch feed 4300, as shown in FIG. 43. Feed 4300 may be used to reduce a four branch delay line phase shifter network to a two branch and one switch network. Feed 4300 may reduce the number of PIN diodes and phase shifter components employed in a feed network of the present invention by 30 percent or more. Input at 4301 is feed to a zero or 90 degree phase shifter 4302, such as phase shifter 4001 described above. The output of phase shifter 4302 is feed through switch 4303 where the signal is switched to either zero phase inputs 4304 of antenna elements 4305 and 4306, or 180 degree phase inputs 4307 of antenna elements 4305 and 4306, via divider 4308 or 4309 to obtain desired phase shifts. In combination phase shifter 4302 and switch 4303 complete a phase shift system of zero, 90, 180 and 270 degrees and alleviates the need for one set of phase shifters in a branch. Further, feed 4300 avoids possible signal cancellation resulting from over 180 degrees shifts within a phase shifter. Other embodiments of a feed network employing phase shifters and switched branch feeding to reduce component counts, while achieving desired phase shift performance, are also possible. For example, phase shifter 4302 may be configured so as to provide 0 degree and 270 degree phase shifts, and feed lines of zero phase input ports 4304 of elements 4305 and 4306 may be extended by a length sufficient to provide an additional 90 degrees of phase shift.

Figure 44:
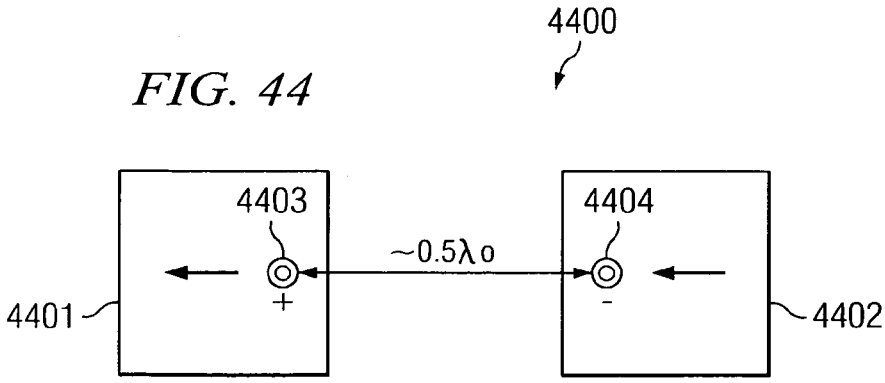
FIG. 44 is a diagrammatic illustration showing differential feed of spaced antenna elements in accordance with another embodiment of the present invention.
Figure 45:
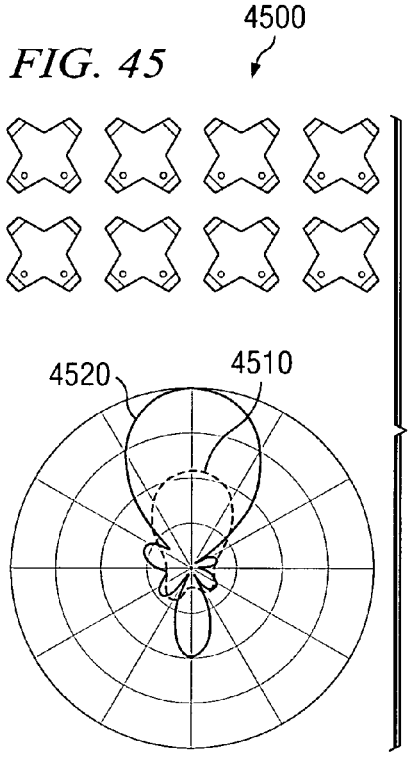
FIG. 45 is a diagrammatic illustration of an array element arrangement embodiment, without differential feed, shown with a resultant antenna beam pattern and cross-polarization power reduction.
Figure 46:
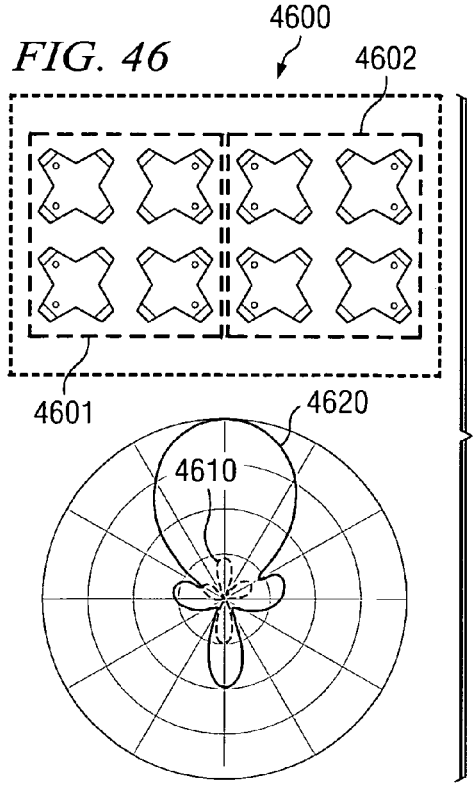
FIG. 46 is a diagrammatic illustration of an array element arrangement embodiment employing differential feed, shown with a resultant antenna beam pattern and cross-polarization power reduction.
Figure 47:
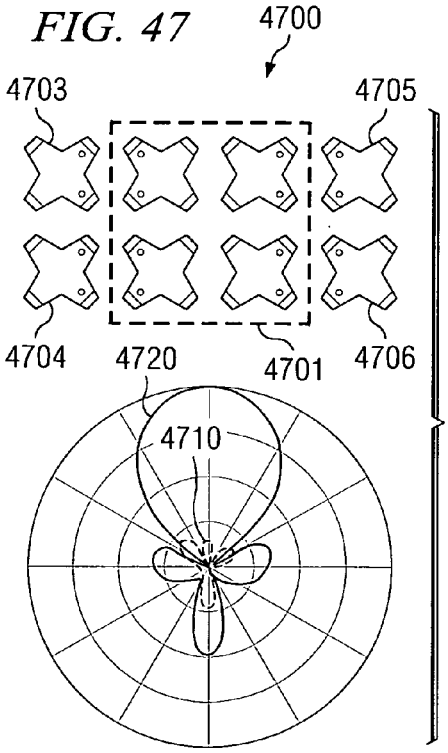
FIG. 47 is a diagrammatic illustration of another array element arrangement embodiment employing differential feed, shown with a resultant antenna beam pattern and cross-polarization power reduction.
Figure 48:
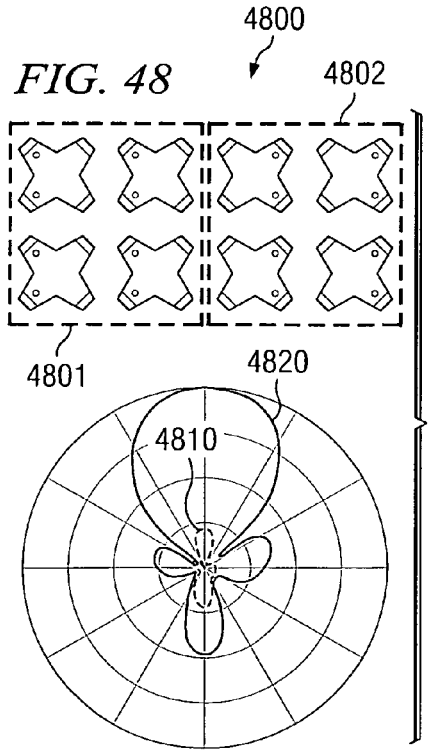
FIG. 48 is a diagrammatic illustration of a third array element arrangement embodiment employing differential feed, shown with a resultant antenna beam pattern and cross-polarization power reduction.

Differential feed 4400 may be used to limit cross-polarization power reduction through the use of opposite phase feed on antenna elements 4401 and 4402, as shown in the illustrated embodiment of FIG. 44. Feeds 4403 and 4404 to antenna elements 4401 and 4402, on opposite sides of the elements, which may be spaced half a wavelength apart, can be feed to provide a signal to the element 180 degrees out of phase. However, the overall field vector of the resultant beam remains in-phase. As shown in FIGS. 46 through 48, subarray differential feed control may be used to take advantage of differential feed placement in arrays to limit cross-polarization power reduction. However, first turning to FIG. 45, array 4500 which does not employ differential feed exhibits a radiation pattern with cross-polarization 4510 of minus 18 dB down from main beam 4520. In FIG. 46 antenna element group 4601 and 4602 of array 4600 form the equivalent of phase cancellation for cross-polarization in array 4600 using differential feed to reduce cross-polarization power reduction. Radiation pattern 4610 is minus 30 dB down from main beam 4620. In FIG. 47, group 4701 of middle elements of array 4700, which have a half wavelength space from feeds of adjacent elements 4703–4706 give about minus 30 dB of cross-polarization isolation between radiation pattern 4710 and main beam 4720. In FIG. 48 antenna element group 4801 and 4802 of array 4800 are disposed with opposite facing feeds to provide differential feed to reduce cross-polarization power reduction. Radiation pattern 4810 is minus 30 dB down from main beam 4820.

A control system for the present inventive antenna array may employ current sensing for fault detection. Preferably, circuitry for such fault sensing is embedded in the feed network to automatically assess total current drawn by an array panel. This circuitry may assesses the total current drawn by the phase shift network. Phase shifts may be randomly activated, or activated in predetermined patterns, to assess if the current drawn by a panel or particular circuitry in a panel, is within acceptable/expected levels. Such testing may be used to determine if diodes in the phase shifters are operational. Preferably, functionality is provided to enable a network administrator to poll an array panel, such as via network management system, to assess if a panel is faulty.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A low cost adaptive multi-beam and multi-diversity antenna array comprising:

a plurality of antenna elements, said elements providing a plurality of beams, each of said beams selectively having diverse characteristics; and an integrated feed network feeding said elements from an input and providing adaptive beam forming for said plurality of beams, said feed network comprising switched phase shifters, wherein said beams are selectively defined in different directions.

2. The array of claim 1 wherein said array is defined within a panel.

3. The array of claim 1 wherein said feed network is defined on a printed circuit board.

4. The array of claim 3 wherein at least a portion of each of said antenna elements are defined on said printed circuit board.

5. The array of claim 1 wherein said feed network employs diodes as switches.

6. The array of claim 5 wherein said diodes are disposed in said phases shifters in a back-to-back configuration.

7. The array of claim 6 wherein said diodes are PIN diodes.

8. The array of claim 1 wherein said array is multi-band.

9. The array of claim 8 wherein the bands share an aperture.

10. The array of claim 8 wherein elements for different bands are interleaved.

11. The array of claim 1 wherein said array is broadband.

12. The array of claim 11 wherein said array has high manufacturing tolerances due to said array being broadband.

13. The array of claim 1 wherein said elements are arranged to provide reduced coupling.

14. The array of claim 1 wherein said elements comprise patch antenna elements.

15. The array of claim 14 wherein said patch elements comprise stacked patch antenna elements.

16. The array of claim 15 wherein said stacked patch antenna elements comprise a parasitic element larger than a feed element.

17. The array of claim 16 wherein said stacked patch element comprises a cross-shaped feed element.

18. The array of claim 17 wherein said cross-shaped feed elements provide reduced mutual coupling between elements.

19. The array of claim 18 wherein said reflector is a ground plane.

20. The array of claim 16 wherein said stacked patch element comprises a cross shaped parasitic element.

21. The array of claim 16 wherein said stacked patch element comprises a generally square parasitic element.

22. The array of claim 15 wherein a parasitic element of said stacked patch antenna elements is spaced in a range of 0.03 to 0.08 wavelengths from a feed element of said stacked patch antenna elements.

23. The array of claim 14 wherein said antenna elements comprise diversity monopole elements.

24. The array of claim 23 wherein said diversity monopole elements comprise a monopole feed element and a ground providing a differential path.

25. The array of claim 24 wherein said ground is a ground plane supporting said feed network.

26. The array of claim 24 wherein said monopole feed element defines a planer disc and is ultra wideband.

27. The array of claim 24 wherein said monopole feed elements define a plurality of rings and are multi-band.

28. The array of claim 24 wherein said monopole feed elements define a square and are broadband.

29. The array of claim 1 further comprising a reflector positioned behind said elements.

30. The array of claim 1 wherein said antenna elements comprise slot integrated patch antenna elements.

31. The array of claim 30 wherein said slot integrated patch antenna elements are feed to provide branch diversity.

32. The array of claim 30 wherein said slot integrated patch antenna elements are feed to provide polarization diversity.

33. The array of claim 30 wherein said slot integrated patch antenna elements are feed to provide branch diversity and polarization diversity.

34. The array of claim 1 wherein each of said antenna elements comprise an integrated magnetic dipole and electric dipole.

35. The array of claim 34 wherein said magnetic dipole is provided by slots defined in grounded material.

36. The array of claim 35 wherein said electric dipole is disposed in said slots.

37. The array of claim 36 wherein said slots are spaced apart and said electric dipole comprises two electric monopoles disposed in said slots.

38. The array of claim 1 wherein spacing of said elements is optimized for scanning angle and gain.

39. The array of claim 38 wherein optimal element spacing is 0.64 wavelengths.

40. The array of claim 1 wherein said array is disposed on a flat surface.

41. The array of claim 1 wherein said array is disposed on a curved surface.

42. The array of claim 1 wherein panels making up said array are disposed at angels relative to one another to define a curved array.

43. The array of claim 1 further comprising directors extending a scanning angle of said array.

44. The array of claim 43 wherein a printed circuit board defining said feed network and supporting said elements support said directors.

45. The array of claim 43 wherein a ground plan reflector disposed behind said elements does not extend behind said directors, thereby aiding steering of beams along a plane of said array.

46. The array of claim 45 further comprising at least one angular reflector disposed at a termination of said ground plane reflector to provide higher gain and optimize tuned beam widths.

47. The array of claim 1 wherein said phase shifters define a plurality of line lengths to provide phase shifts by switching between said line lengths.

48. The array of claim 47 wherein said line lengths are provided by reduced size phase shift lines.

49. The array of claim 48 wherein ones of said reduced size phase shift lines are combined in paths through a phase shifter to provide desired phase shift paths.

50. The array of claim 47 wherein said phase shifts are discrete.

51. The array of claim 47 further comprising diodes disposed in one or more of said line lengths to provide isolation of between said line lengths.

52. The array of claim 47 further comprising diodes disposed in one or more of said line lengths, spaced apart from junctions of said line lengths to provide isolation between said line lengths.

53. The array of claim 51 further comprising diodes disposed in one or more of said line lengths, spaced apart from junctions of said line lengths to prevent opposite phased power leakage cancellation between different ones of said line lengths.

54. The array of claim 51 further comprising diodes disposed in one or more of said line lengths, spaced apart from junctions of said line lengths to cancel resonance effects in said line lengths.

55. The array of claim 1 wherein said feed network feeds said elements in two orthogonal branches.

56. The array of claim 55 wherein said feed network comprises a phase shifter to provide two orthogonal phases and a switch to selectively feed one of said orthogonal branches.

57. The array of claim 1 wherein said feed network comprises differential feeds for said elements.

58. The array of claim 57 wherein said differential feeds for said elements provide signals to said element 180 degrees out of phase.

59. The array of claim 1 further comprising controls having fault detection provided by current sensing to assess the current drawn by said phases shifters of said feed network to determine proper operation of said feed network phase shifters.

60. A low cost adaptive multi-beam and multi-diversity antenna array comprising:

a plurality of antenna elements, said elements providing a plurality of beams, each of said beams selectively having diverse characteristics; and an integrated feed network feeding said elements from an input and providing adaptive beam forming for said plurality of beams, said feed network comprising switched phase shifters wherein said characteristics include beam polarization.

61. A low cost adaptive multi-beam and multi-diversity antenna array comprising:

a plurality of antenna elements, said elements providing a plurality of beams, each of said beams selectively having diverse characteristics; and an integrated feed network feeding said elements from an input and providing adaptive beam forming for said plurality of beams, said feed network comprising switched phase shifters wherein said characteristics include beam width.

62. A low cost adaptive multi-beam and multi-diversity antenna array comprising:

a plurality of antenna elements, said elements providing a plurality of beams, each of said beams selectively having diverse characteristics; and an integrated feed network feeding said elements from an input and providing adaptive beam forming for said plurality of beams, said feed network comprising switched phase shifters wherein said array is a wireless local area network antenna array.

63. A low cost adaptive multi-beam and multi-diversity antenna array panel comprising:

a plurality of antenna elements defined at least in part on a printed circuit board, said elements providing a plurality of beams, each of said beams selectively having diverse characteristics; and a feed network defined on said printed circuit board, said feed network feeding said elements from an input and providing adaptive beam forming for said plurality of beams, said feed network comprising switched phase shifters.

64. The panel of claim 63 wherein said panel provides a wireless local area network antenna array.

65. The panel of claim 63 wherein said phase shifters employs PIN diodes as switches.

66. The panel of claim 63 wherein said array is multi-band with the bands sharing a common aperture.

67. The panel of claim 66 wherein elements for different bands are interleaved on said printed circuit board.

68. The panel of claim 63 wherein said elements are adapted to fit on said panel.

69. The panel of claim 63 wherein said elements are arranged to provide reduced coupling.

70. A low cost adaptive multi-band, multi-beam and multi-diversity antenna array comprising:

a plurality of lower frequency antenna elements, said lower frequency elements providing a plurality of lower frequency beams, each of said lower frequency beams selectively having diverse characteristics;

a plurality of higher frequency antenna elements interleaved with said lower frequency elements, said higher frequency elements providing a plurality of higher frequency beams, each of said higher frequency beams selectively having diverse characteristics; and an integrated feed network feeding said plurality of lower frequency antenna elements from a separate input from said higher frequency antenna elements and providing adaptive beam forming for said plurality of beams, said feed network comprising switched phase shifters.

71. The array of claim 70 wherein said lower frequency beams and said higher frequency beams share an aperture of said array.

72. The array of claim 70 wherein said array is a wireless local area network antenna array.

73. A low cost adaptive multi-beam and multi-diversity wireless local area network antenna array panel comprising:

a plurality of antenna elements defined at least in part on a printed circuit board, said elements providing a plurality of beams, each of said beams selectively having diverse characteristics; and a feed network defined on said printed circuit board, said feed network feeding said elements from an input and providing adaptive beam forming for said plurality of beams, said feed network comprising switched phase shifters.

74. The panel of claim 73 wherein said array is multi-band with the bands sharing a common aperture.

75. The panel of claim 74 wherein elements for different bands are interleaved on said printed circuit board.

76. The panel of claim 73 wherein said elements are adapted to fit on said panel.

77. The panel of claim 73 wherein said elements are arranged to provide reduced coupling.

78. A method for adaptively providing multiple antenna beams having multi-diversity at low cost, said method comprising:

feeding a plurality of antenna elements with a switched phase shifter feed network;

providing, by said elements, a plurality of antenna beams, each of said beams selectively having diverse characteristics; and providing by said feed network adaptive beam forming for said plurality of beams, wherein said characteristics include beam width.

79. The method of claim 78 wherein said feeding further comprises employing diodes as switches.

80. The method of claim 79 wherein said employing further comprises disposing said diodes in said phases shifters back-to-back.

81. The method of claim 78 wherein said providing further comprises providing, by said elements, antenna beams of a plurality of bands.

82. The method of claim 81 wherein said bands share an antenna aperture.

83. The method of claim 81 further comprising interleaving elements for different bands.

84. The method of claim 78 further comprising arranging said elements to reduced mutual coupling between elements.

85. The method of claim 78 further comprising defining said plurality of antenna elements and said feed network, at least in part, on a same printed circuit board.

86. The method of claim 78 wherein said providing further comprises providing a plurality of lower frequency beams, employing a plurality of lower frequency ones of said antenna elements, ones of said lower frequency beams selectively having diverse characteristics, and providing a plurality of higher frequency beams, employing a plurality of higher frequency ones of said antenna elements, ones of said higher frequency beams selectively having diverse characteristics.

87. The method of claim 86 wherein said feeding further comprises feeding said plurality of lower frequency elements and said plurality of higher frequency elements from a separate input.

88. The method of claim 78 wherein said elements comprise patch antenna elements.

89. The method of claim 88 wherein said patch elements comprise stacked patch antenna elements.

90. The method of claim 89 wherein said stacked patch antenna elements comprise a parasitic element larger than a feed element.

91. The method of claim 90 wherein said stacked patch element comprises a cross-shaped feed element.

92. The method of claim 91 wherein said cross-shaped feed elements provide reduced mutual coupling between elements.

93. The method of claim 89 wherein said stacked patch element comprises a cross shaped parasitic element.

94. The method of claim 89 wherein said stacked patch element comprises a generally square parasitic element.

95. The method of claim 88 wherein said antenna elements comprise diversity monopole elements.

96. The method of claim 95 wherein said diversity monopole elements comprise a monopole feed element and a ground providing a differential path.

97. The method of claim 96 further comprising providing a wherein said ground is a ground plane supporting said feed network.

98. The method of claim 78 further comprising a reflector positioned behind said elements.

99. The method of claim 98 wherein said reflector is a ground plane.

100. The method of claim 78 wherein said antenna elements comprise slot integrated patch antenna elements.

101. The method of claim 100 further comprising:

feeding said slot integrated patch antenna elements to provide at least one of branch diversity and polarization diversity.

102. The method of claim 78 wherein each of said antenna elements comprise an integrated magnetic dipole and electric dipole.

103. The method of claim 102 further comprising:

defining slots in grounded material to provide said magnetic dipole.

104. The method of claim 103 further comprising:

disposing said electric dipole in said slots.

105. The method of claim 104 further comprising:

spacing said slots apart; and disposing electric monopoles in said slots to provide said electric dipole.

106. The method of claim 78 further comprising:

optimizing said spacing of said elements for scanning angle and gain.

107. The method of claim 106 wherein optimal element spacing is 0.64 wavelengths.

108. The method of claim 78 further comprising:

providing directors extending a scanning angle of an array comprised of said elements.

109. The method of claim 108 further comprising:

supporting said directors with a printed circuit board defining said feed network and supporting said elements.

110. The method of claim 108 further comprising:

aiding steering of beams along a plane of said array by disposing a ground plan reflector behind said elements to not extend behind said directors.

111. The method of claim 110 further comprising:

providing higher gain and optimizing tuned beam widths using at least one reflector disposed at a termination of said ground plane reflector.

112. The method of claim 78 further comprising:

defining a plurality of line lengths in said phase shifters to provide phase shifts by switching between said line lengths.

113. The method of claim 112 wherein said line lengths are reduced size phase shift lines.

114. The method of claim 113 further comprising:

combining ones of said reduced size phase shift lines in paths through a phase shifter to provide desired phase shift paths.

115. The method of claim 112 wherein said phase shifts are discrete.

116. The method of claim 112 further comprising:

disposing diodes in one or more of said line lengths to provide isolation of between said line lengths.

117. The method of claim 116 further comprising:

disposing said diodes in one or more of said line lengths, spaced apart from junctions of said line lengths to provide said isolation between said line lengths.

118. The method of claim 116 further comprising:

disposing said diodes in one or more of said line lengths, spaced apart from junctions of said line lengths to prevent opposite phased power leakage cancellation between different ones of said line lengths.

119. The method of claim 116 further comprising:

disposing said diodes in one or more of said line lengths, spaced apart from junctions of said line lengths to cancel resonance effects in said line lengths.

120. The method of claim 78 further comprising:

feeding said elements, by said feed network, using two orthogonal branches.

121. The method of claim 120 further comprising:

providing two orthogonal phases using a phase shifter of said feed network; and selectively switching a feed to one of said orthogonal branches.

122. The method of claim 78 wherein said feed network comprises differential feeds for said elements.

123. The method of claim 122 further comprising:

providing signals to said elements 180 degrees out of phase using said differential feeds for said elements.

124. The method of claim 78 further comprising:

detecting faults in said feed network by sensing current to assess the current drawn by said phases shifters of said feed network, thereby determining proper operation of said feed network phase shifters.

125. A method for adaptively providing multiple antenna beams having multi-diversity at low cost, said method comprising:

feeding a plurality of antenna elements with a switched phase shifter feed network;

providing, by said elements, a plurality of antenna beams, each of said beams selectively having diverse characteristics;

providing by said feed network adaptive beam forming for said plurality of beams; and selectively defining said beams in different directions.

126. A method for adaptively providing multiple antenna beams having multi-diversity at low cost, said method comprising:

feeding a plurality of antenna elements with a switched phase shifter feed network;

providing, by said elements, a plurality of antenna beams, each of said beams selectively having diverse characteristics; and providing by said feed network adaptive beam forming for said plurality of beams, wherein said characteristics include beam polarization.

* * * * *